US005323500A

United States Patent [19]

Roe et al.

[11] Patent Number: 5,323,500

[45] Date of Patent: Jun. 28, 1994

[54] CUSHIONS FOR A BED

[75] Inventors: Steven N. Roe, Los Altos; Robert J. Ferrand, Burlingame; Marc M. Thomas, Portola Valley, all of Calif.

[73] Assignee: American Life Support Technology, Redwood City, Calif.

[21] Appl. No.: 935,897

[22] Filed: Aug. 26, 1992

Related U.S. Application Data

[60] Continuation-in-part of Ser. No. 864,881, Apr. 3, 1992, Pat. No. 5,279,010, which is a continuation-in-part of Ser. No. 641,697, Jan. 16, 1991, Pat. No. 5,138,729, which is a division of Ser. No. 511,842, Apr. 20, 1990, Pat. No. 5,023,967, which is a continuation of Ser. No. 172,264, Mar. 23, 1988, abandoned.

[51] Int. Cl.[5] ..... A61G 7/06

[52] U.S. Cl. ..... 5/453; 5/455; 5/465; 5/630

[58] Field of Search ..... 5/630, 632, 648, 449, 5/453, 455, 465

[56] References Cited

U.S. PATENT DOCUMENTS

| | | | |
|---|---|---|---|
| 1,198,687 | 9/1916 | Williams et al. | 5/449 |
| 2,415,150 | 2/1947 | Stein | 5/455 |
| 3,218,103 | 11/1965 | Boyce | 297/384 |
| 3,284,817 | 11/1966 | Landwirth | 5/630 X |
| 3,674,019 | 7/1972 | Grant | 128/33 |
| 3,935,604 | 2/1976 | Collins | 5/455 X |
| 3,938,205 | 2/1978 | Spann | 5/632 |
| 4,193,149 | 3/1980 | Welch | 5/447 |
| 4,205,669 | 6/1980 | Hamann | 128/134 |
| 4,234,982 | 11/1980 | Bez et al. | 5/449 X |
| 4,255,824 | 3/1981 | Pertchik | 5/441 |
| 4,534,078 | 8/1985 | Viesturs et al. | 5/452 |
| 4,768,249 | 12/1988 | Goodwin | 5/453 |
| 4,999,867 | 5/1991 | Toivio et al. | 5/455 |
| 5,003,654 | 4/1991 | Vrzalik | 5/453 |
| 5,035,014 | 7/1991 | Blanchard | 5/424 |
| 5,138,729 | 8/1992 | Ferrand | 5/455 X |

*Primary Examiner*—Michael F. Trettel
*Attorney, Agent, or Firm*—Flehr, Hohbach, Test, Albritton & Herbert

[57] ABSTRACT

A bed comprises an inflatable mattress supported on a platform of articulable links by a support system mounted on a base frame. A connector assembly is used to couple the cells to the platform, to adjacent cells, and to tubes connected to other cells. The mattress includes lateral cushions or cells that have a general triangular shape with larger upper cells forming a patient support surface and smaller base cells laterally supporting the upper cells. The upper cells may be elevated at the ends to form a broad U or V shape. Alternative embodiments include shorter base and upper cells with a box-shaped restraining cell on each end that extends above the upper cells. Modified upper cells have end pouches that store separate restraint cells when deflated, and provide inflation pressure when removed by a fixed connecting tube. The restraint cells are positionable along the host upper cell and anchor to catches mounted on the adjacent base cells.

32 Claims, 19 Drawing Sheets

111
118
112
116
8
9
90
114
118
112

CUSHIONS FOR A BED

CROSS-REFERENCES TO RELATED APPLICATIONS

This is a continuation-in-part of U.S. patent application Ser. No. 07/864,881 filed on Apr. 3, 1992, now U.S. Pat. No. 5,279,010 which application is a continuation-in-part of U.S. patent application Ser. No. 07/641,697 filed on Jan. 16, 1991, now U.S. Pat. No. 5,138,729 which application is a division application of U.S. patent application Ser. No. 07/511,842 filed on Apr. 20, 1990, issued as U.S. Pat. No. 5,023,967, which application is a continuation of U.S. patent application Ser. No. 07/172,264 filed Mar. 23, 1988, now abandoned.

FIELD OF THE INVENTION

This invention relates generally to beds, and more particularly, to supporting and restraining cushions facilitating care of a person supported on the bed.

BACKGROUND OF THE INVENTION

Beds generally, and hospital beds in particular have recently been undergoing a design transformation. Early beds were very basic devices providing limited support and care features. More recently, bed designs have been taking advantage of technological developments to provide improvements in bed articulation, mattress inflation, patient access, convenience and control.

Inflatable mattress cushions or cells in such beds are often connected to a support surface of a base platform or frame. These connections may be provided by a connector having an inner channel or passageway, that attaches the cell to a port extending through the support surface. Further, it is known to connect two cells together with a passageway formed in the connection to allow air to flow between the connected cells. An example of such an arrangement is disclosed by Pertchik in U.S. Pat. No. 4,255,824 for "Cushion for Decubitus Ulcers". Pertchik discloses a cushion for sitting formed of a plurality of elongate cells that are connected at contact points to provide inflation of all the cells from a single inlet.

Various forms of cushions and mattresses have been designed in order to provide improved support for a patient. Viesturs et al., in U.S. Pat. No. 4,534,078 entitled "Body Supporting Mattress", disclose an elongate inner cell supported on a pad having a peripheral inflated tube. Generally U-shaped cells that alternate and are offset for use in turning a patient are disclosed in U.S. Pat. No. 5,003,654 issued to Vrzalik for a "Method and Apparatus for Alternating Pressure of a Low Air Loss Patient Support System". In U.S. Pat. No. 4,768,249 entitled "Patient Support Structure", Goodwin discloses a more conventional low air loss mattress formed of upright cells extending across the width of the bed.

Such mattresses as shown by Goodwin and Vrzalik are prone to bend or lean into an adjoining cell location when the adjoining cell is deflated. This tends to reduce the effectiveness of controlling the support pressure and location, which is necessary in the avoidance and treatment of bed sores, and also in the articulation of the bed.

It is also known to provide mattresses that have multiple layers. Grant, in U.S. Pat. No. 3,674,019 entitled "Dual Layer Cellular Inflatable Pad", describes a pad formed of offset layers of interdigitated inflatable sections. Welch, in U.S. Pat. No. 4,193,149 entitled "Beds and Mattresses", discloses a similar mattress, except the layer cells are aligned and separated by a preformed foam. Such mattresses assure resilient support for a patient, but provide limited control of support by adjacent cells.

Various cushions are also known for restraining a person. An elaborate example is disclosed by Boyce in U.S. Pat. No. 3,218,103 entitled "Pneumatic Restraint System". This patent discloses a chair having inflatable bands shiftable in position for selectively restraining a person. A restraining device that is releasably attached to a support platform for placement across the body of an infant is disclosed in U.S. Pat. No. 4,205,669 issued to Hamann for "Diaper-Changing Aid".

There thus remains a need for a means for restraining a person on a bed. In particular, it is desirable to have lateral cushions that conform to the sides of a person, and selectively inflatable cushions that are positionable over a person for keeping the person in the bed.

SUMMARY OF THE INVENTION

The various features of the present invention satisfy these heretofore unrealized needs.

A bed made according to the present invention comprises a platform having a generally planar upward facing support surface and an inflatable mattress. The mattress comprises first and second separately inflatable cells having contiguous faces extending, when inflated, obliquely relative to the support surface, such that the contiguous face of the first cell extends over the contiguous face of the second cell. Securing means secure the first and second cells to the platform, whereby the first cell is partially supported on the second cell when a person is supported on the mattress. Individual cell support thereby results, regardless of the extend of inflation of adjacent cells.

In another aspect of the invention, an auxiliary cell is provided for use with an inflatable mattress having at least one inflatable cell extending laterally for supporting a person. The one cell has an envelope for storing the auxiliary cell in a deflated condition. A conduit couples the one cell and the auxiliary cell for inflating said auxiliary cell when removed from said envelope.

The present invention also includes, generally, an auxiliary cell that is positionable along the length of a supporting cell by means selectively engageable for securing the auxiliary cell relative to the support surface.

In the preferred embodiment of these aspects of the invention, the auxiliary cell has side flaps with hooks that extend down along the sides of the one cell. The one or upper cell and associated adjacent base cells are triangular in shape. A side of a base cell on the support surface and a side of the upper surface forming the surface for supporting a person. Anchors distributed along the upper ridge of the smaller base cells are engageable by the hooks for securing the auxiliary cell on the one cell.

In yet another aspect of the invention, a restraining cushion assembly includes a plurality of inflatable restraining cushions sized to fit serially between the mattress sides and over a person supported on the mattress. Means are provided for securing the restraining cushions relative to the mattress and for inflating a first one of the restraining cushions. The first restraining cushion is coupled to a second restraining cushion for providing fluid communication between the first and second restraining cushions, so that the second restraining cushion inflates when the first cushion inflates.

An alternative restraining cushion assembly includes a pair of restraining cushions sized to fit serially on the mattress between the mattress sides in spaced-apart relationship. The restraining cushions each having a first side that is generally orthogonal to and longer than a second side when viewed from an end of the mattress, wherein each of the restraining cushions are positionable selectively with one of the first and second sides on the mattress and the other of the first and second sides facing inwardly toward a person supported on the mattress. The pair of restraining cushions are positionable at different positions along a person's body for providing different amounts of space between the cushions for a person supported on the mattress.

It will thus be seen that the various mattress cell designs and assemblies, and the various restraining cushion assemblies provided by the present invention improve the handling and comfort of a person supported on or restrained by them, while being convenient to use by a person caring for the supported person. These and other features and advantages of the present invention will be apparent from the following detailed description of the preferred embodiments of the invention, described for purposes of illustration but not limitation, and as illustrated in the accompanying drawings.

DETAILED DESCRIPTION OF THE PREFERRED EMBODIMENTS

General Overview

Figure 1:
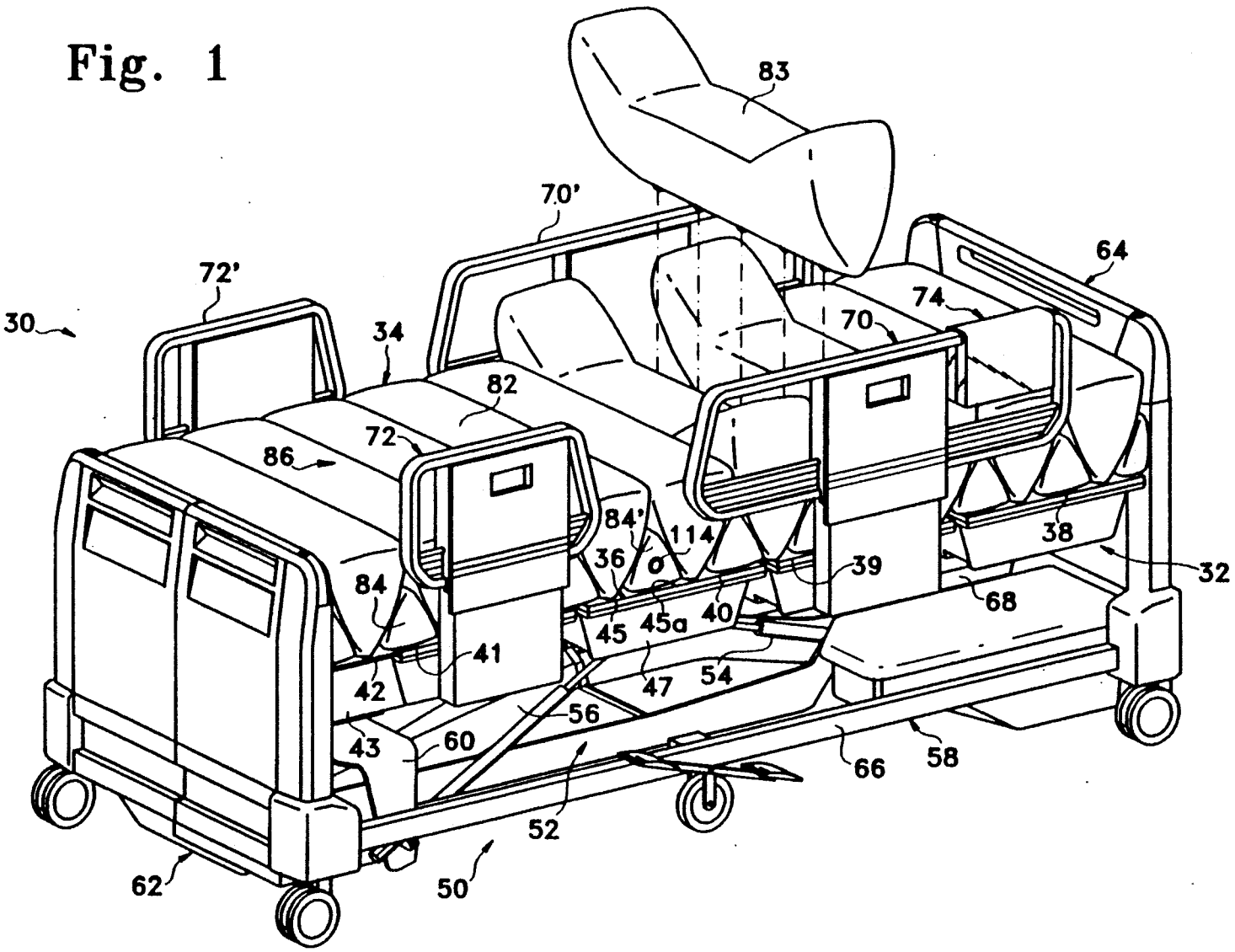
FIG. 1 is an isometric view of a hospital bed made according to the present invention.

Referring initially to FIG. 1, a bed 30 made according to the invention is shown. Bed 30 includes a pneumatic system 32 for controllably inflating a mattress 34 supported on a platform 36 formed of mutually articulating links or panels 38, 39, 40 and 41. Panel 38 is at what is referred to as the head of the bed, and panel 41 is at the foot of the bed. Panel 41 also includes an extension portion 42 that includes an equipment housing 43. Each panel has a top plate 45 with a top, supporting surface **45*a*, and a subtending tray 47**.

Platform 36 is supported above a base assembly 50 by a supporting apparatus 52 that includes opposing hydraulic supports 54 and 56 mounted at spaced locations on the base assembly and at a common universal mounting hidden from view. This structure is like the structure described in U.S. Pat. No. 5,023,967 issued to Ferrand for "Patient Support System", and also has various features described in U.S. patent application Ser. No. 07/864,881 of Ferrand et al. for "Patient Care System".

The platform and support system are supported on a base frame 58 at the foot of the bed by a yoke member 60. Base frame 58 includes a footboard assembly 62, a headboard assembly 64, and connecting side rails 66 and 68. Bed 30 also has patient guard rail assemblies, such as assemblies 70 and 72, positioned along the platform sides. The manipulation and control of the bed, and other patient care systems, are provided by a portable "saddle-bag" controller 74 that wraps around a guard rail, as shown.

Figure 2:
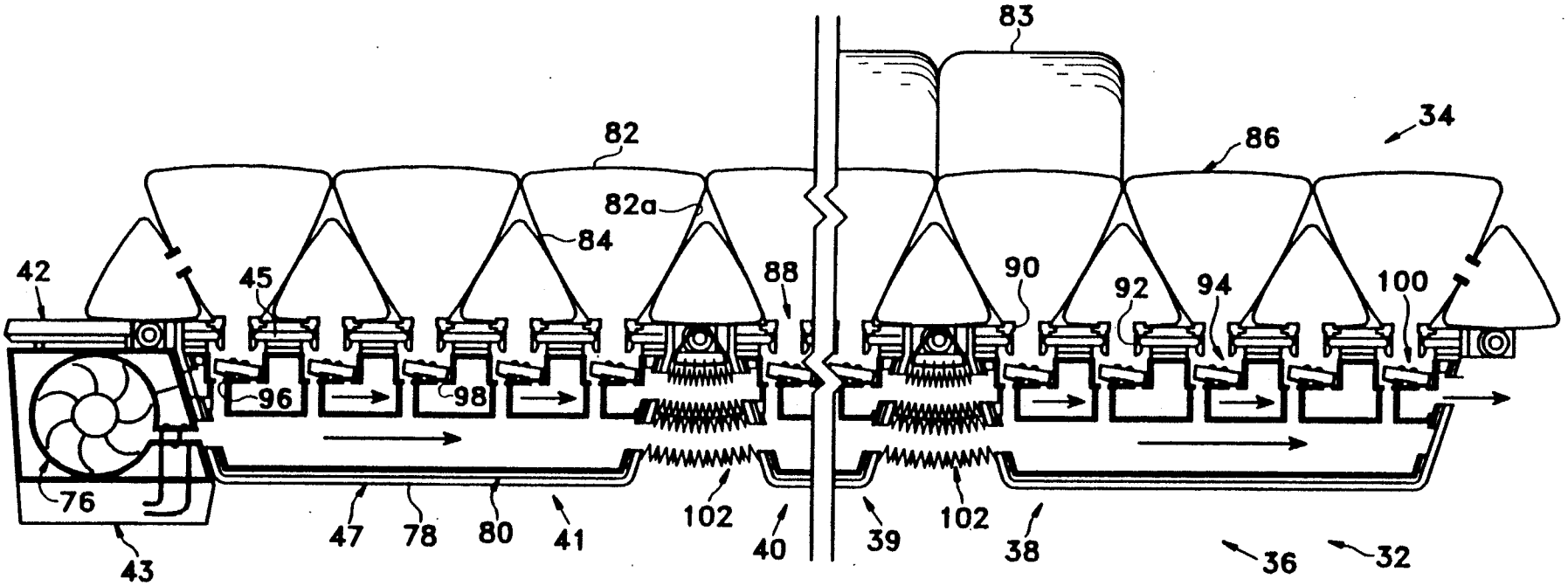
FIG. 2 is a side cross section showing the mattress of the bed of FIG. 1.

Referring now to FIG. 2, pneumatic or air distribution system 32 is shown in further detail. System 32 includes a source of pressurized fluid, such as a blower 76 that forces air serially through respective trays 47 of each of panels 38–41, as shown. Each panel includes, generally, a basin or outer tray 78, and an inner tray assembly 80. Each tray assembly defines manifolds used for distributing air to and from individual cushions or cells, such as upper cells 82 and 83 and base cells 84 of mattress 34.

As can be seen in FIGS. 1 and 2, mattress 34 has upper cells 82 and 83 alternating with base cells 84. As viewed in FIG. 2, both upper and base cells are generally triangle shaped, with a base of a cell 84 supported on the associated platform, and a point of a cell 82 or 83 supported on the platform. Since cells 82 and 83 are larger than cells 84, they extend above the base cells. The upper or patient support surface 86 of the bed is thus formed by the upper, exposed surfaces of cells 82. The larger cells thus have faces or sides, such as sides 82*a* and 83*a*, that extend at an oblique angle to the platform and over the tops of the lower cells, and the adjacent side walls of adjacent cells touch.

During articulation of the bed, different combinations of upper and base cells are deflated to allow pivoting of the associated panels. When a base cell is deflated, the upper cell is then allowed to pivot over. This is generally avoided. However, when an upper cell is deflated, the adjacent upper cells do not move to fill in the gap, because the intervening base cell acts as a wedge to keep them from moving. Thus, so long as the base cells are inflated, the upper cells are independently pressure-controllable, without altering the cell position. Since the face of the base cell is supported on the platform, it also does not bend. Thus, a very stable cushion system is provided with this combination cell structure.

Figure 3:
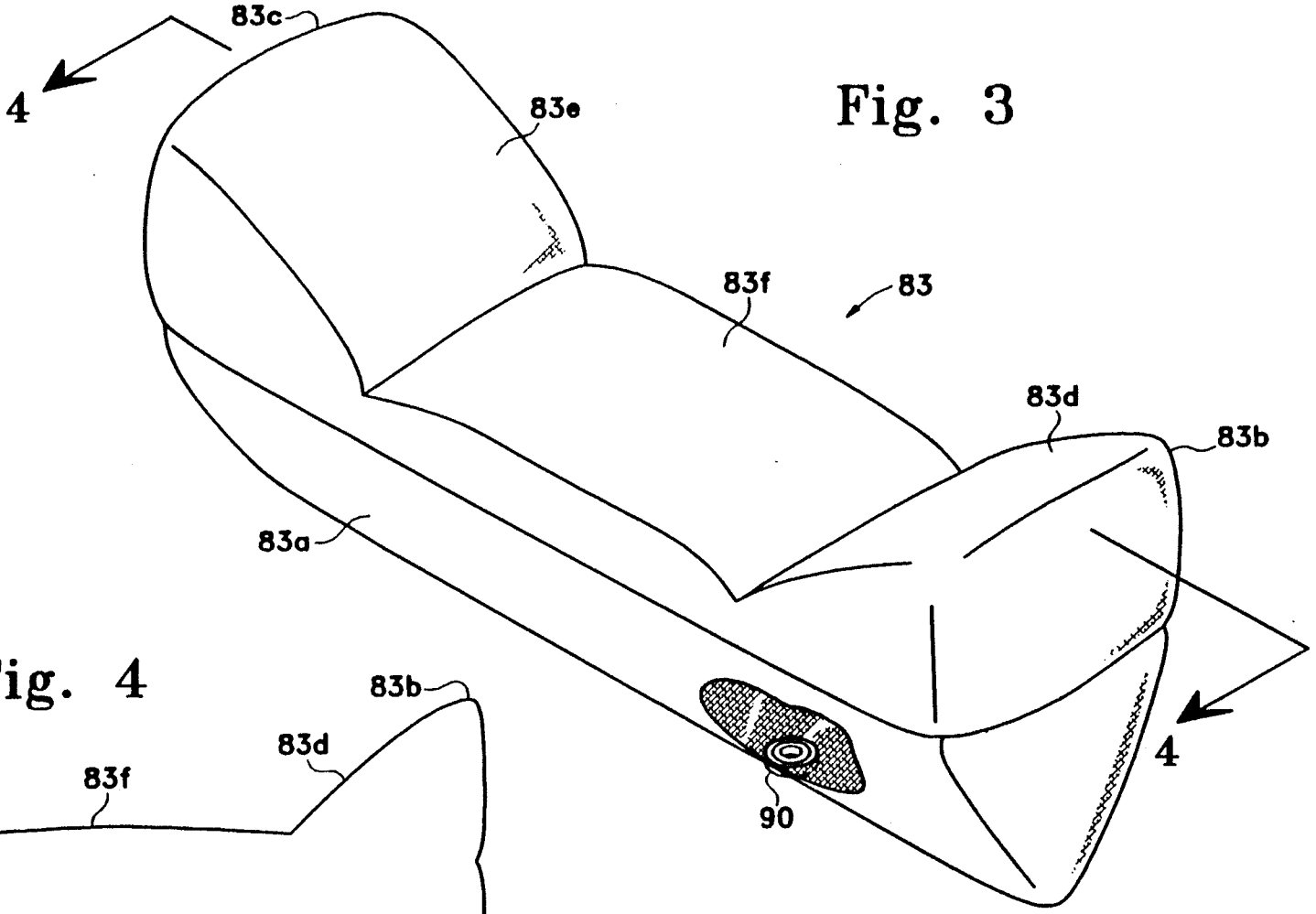
FIG. 3 is an isometric view of a restraining cushion of the bed of FIG. 1.
Figure 4:
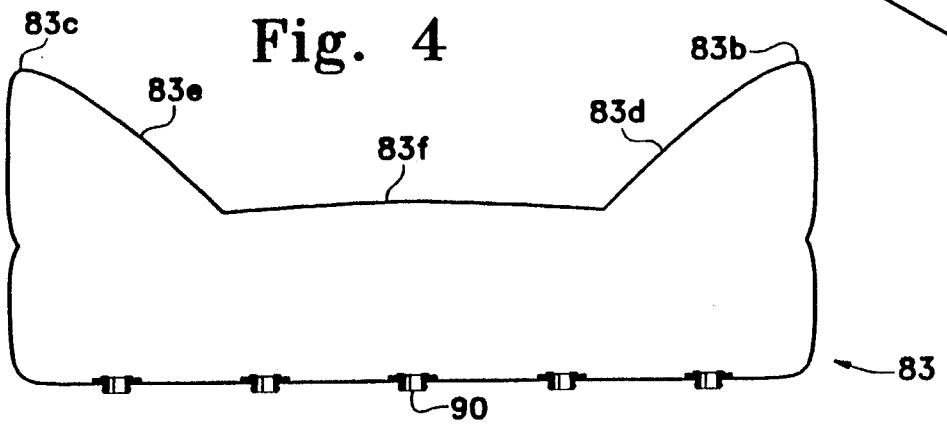
FIG. 4 is a simplified cross section taken along line 4—4 in FIG. 3.

As shown in FIGS. 3 and 4, upper cells 83 have elevated ends 83*b* and 83*c* that slope relatively steeply along surfaces 83*d* and 83*e* to the level of mattress surface 86 provided by intermediate surface 83*f*.

Figure 23:
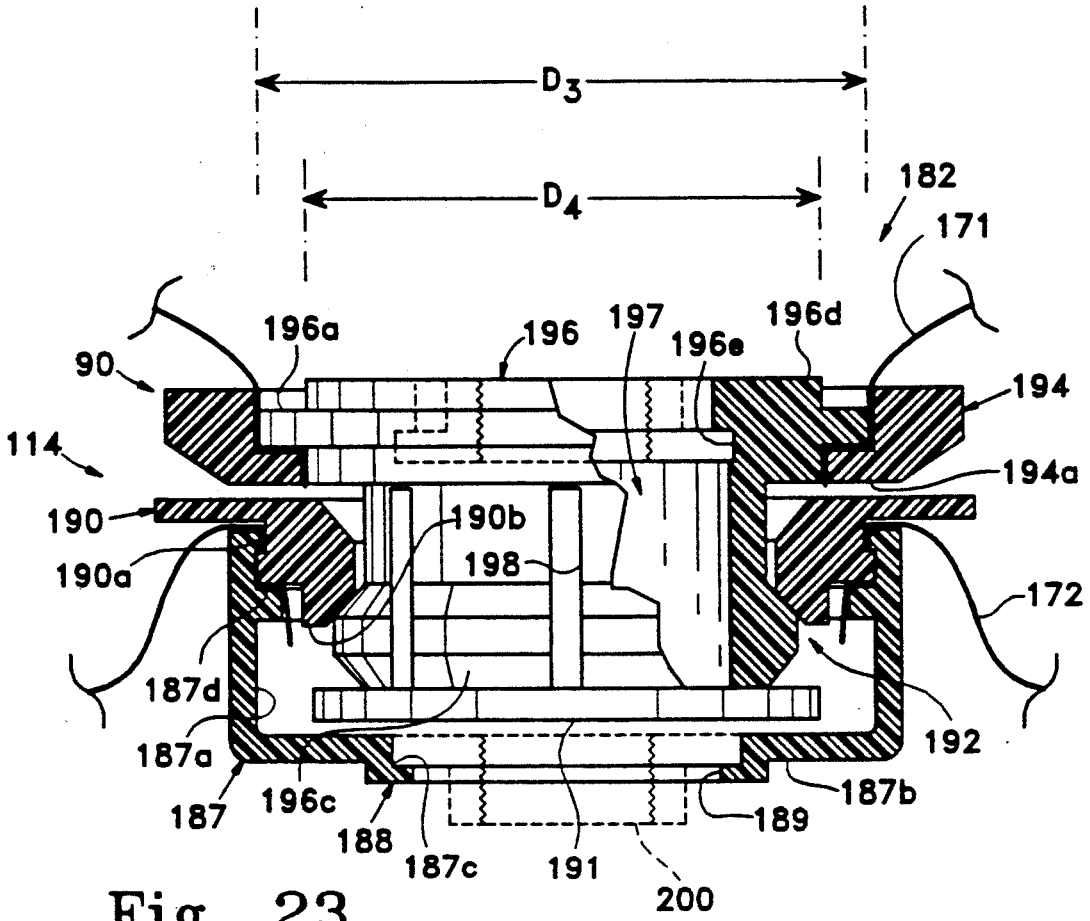
FIGS. 23 and 24 illustrate connector assemblies for use in the cushions of the previous figures.
Figure 24:
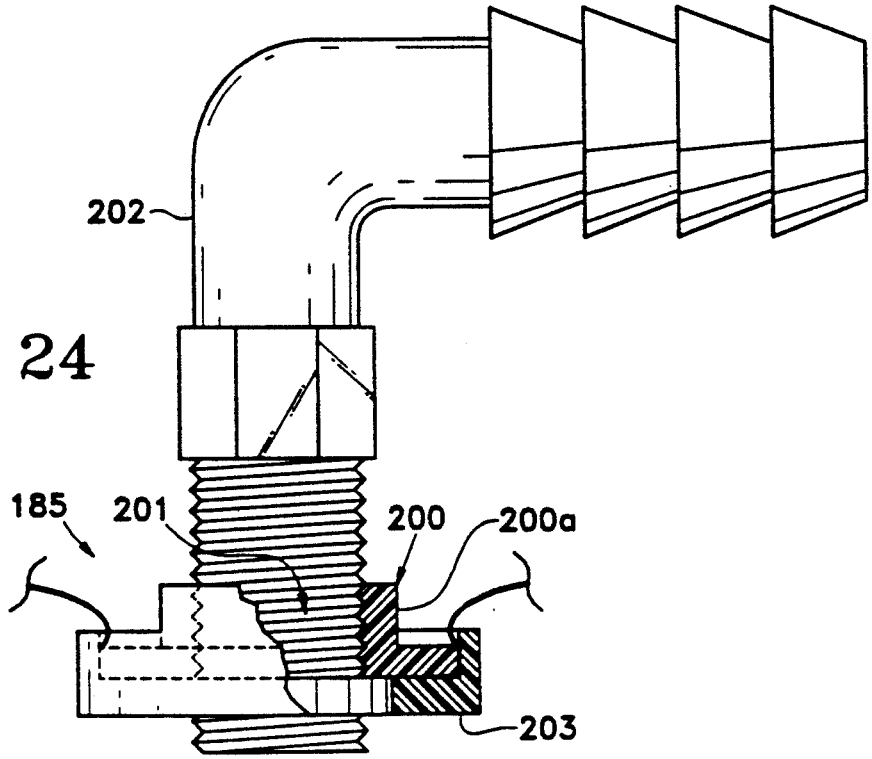

The cells have fluid-flow ports, such as port 88 formed by the combination of cell fabric or envelope, such as a breathable or waterproof fabric as are well known, and an insert connector 90, to be described further with reference to FIGS. 23 and 24. The insert connector sealingly snaps into a coupling port 92 extending through the upper plate of the associated platform. Below port 92 is a control chamber 94 that has substantially the same pressure as the associated cell.

The control chamber is defined by the platform plate and tray assembly 80. It has an inlet fluid-flow port 96 and an outlet or exhaust fluid-flow port 98. Mounted relative to the inlet and outlet ports is a valve assembly 100, for selectively controlling the air pressure in the associated mattress cell. One or a plurality of control chambers may be associated with each cell.

The panels are all made with the same base components of top plate, outer tray, inner tray assembly and associated sealing materials. As has been mentioned, the top plate has an array of coupling ports for connection with associated mattress cells, there being a control chamber and valve assembly for each coupling port.

Although not shown, sensor receptors and processor controllers are also preferably mounted in or on the trays, with associated pressure and temperature sensors mounted in the corresponding control chambers. The trays are preferably formed with troughs for holding such devices.

The pneumatic system 32 also includes a bellows assembly 102 for providing fluid communication between associated fluid-flow ports in the adjacent panels, as shown.

Restraining cell 83 as shown in FIGS. 3 and 4 has an intermediate, generally planar upper surface 83*f* that accommodates a person's body, particularly the torso section, as is provided in mattress 34 illustrated in FIG. 1. The limited amount of restraint provided by these cells is adequate for a person that needs little control to assure that he or she will remain in bed or that does not need to be held in a fixed position.

Figure 5:
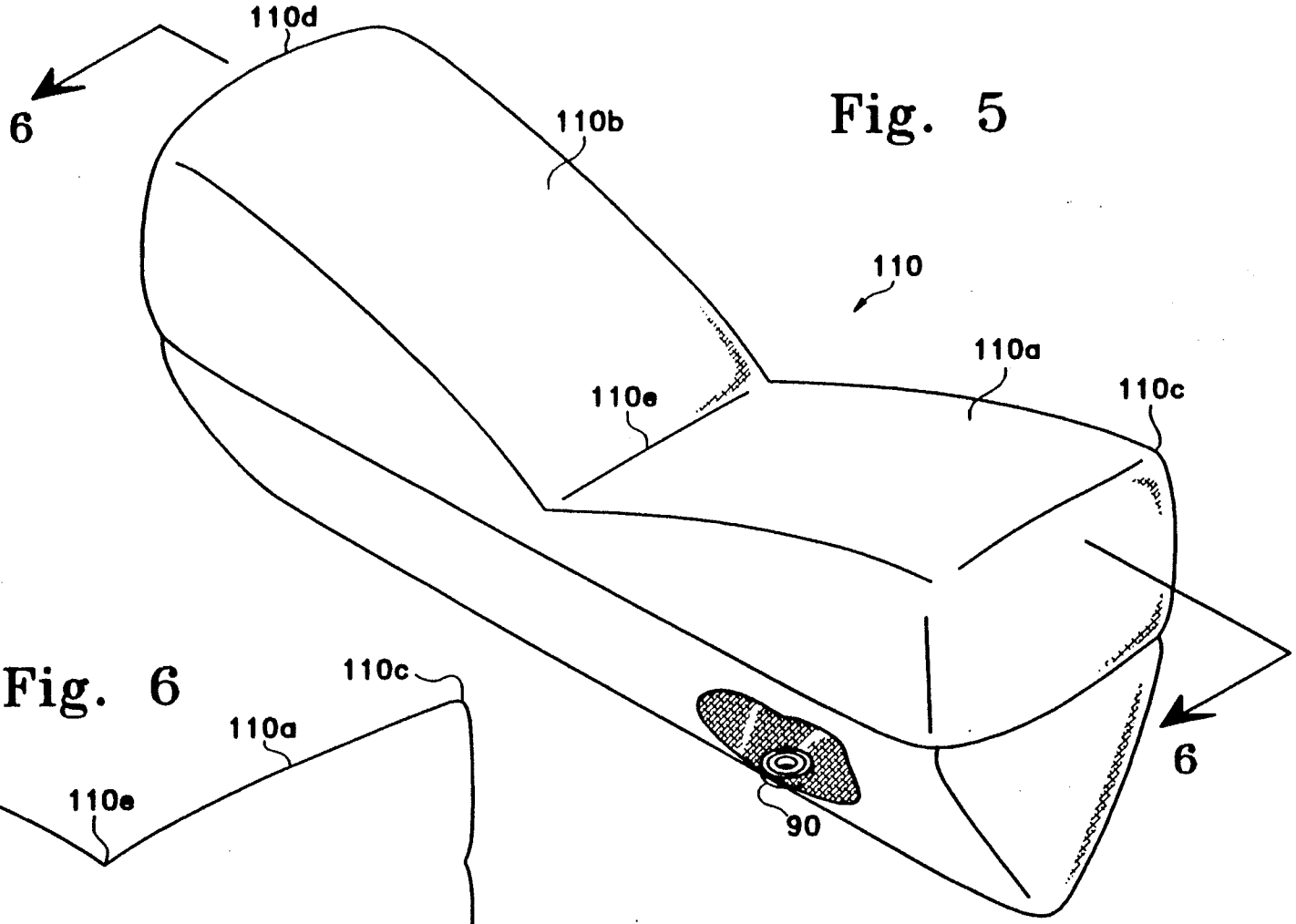
FIG. 5 is an isometric view similar to FIG. 3 of an alternative embodiment of the restraining cushion.
Figure 6:
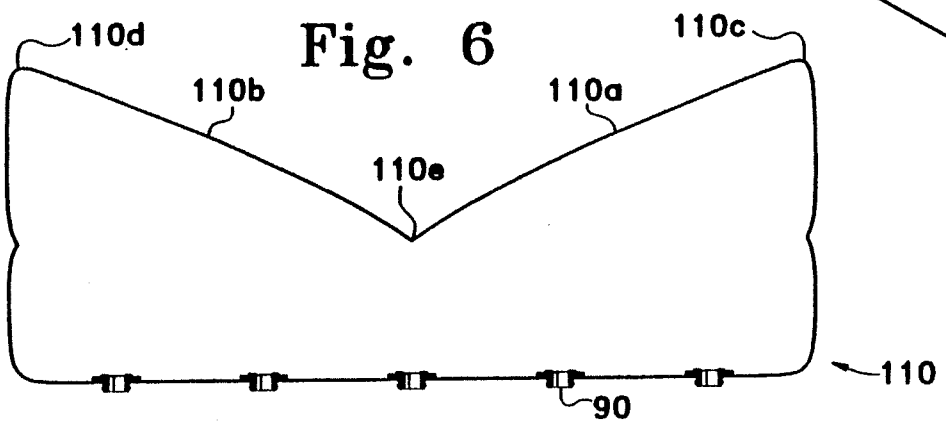
FIG. 6 is a simplified cross section taken along line 6—6 in FIG. 5.

If further restraint is desirable, a mattress cell 110 as shown in FIGS. 5 and 6 may also be used. Cell 110 is similar to cell 83, except that opposing upper surfaces 110*a* and 110*b* slope from an elevated position at the ends 110*c* and 110*d*, respectively, of the cell down to the center 110*e*. This cell thus urges the part of a patient's body supported in it toward the center of the bed. Thus, it inhibits any movement toward the side of the bed. It is particularly useful for supporting the head of a patient, and also may be used to support the feet. It would simply be installed in a bed 30 where desired, by replacing a basic upper cell 82 with a cell 110.

Figures 7, 8, 9:
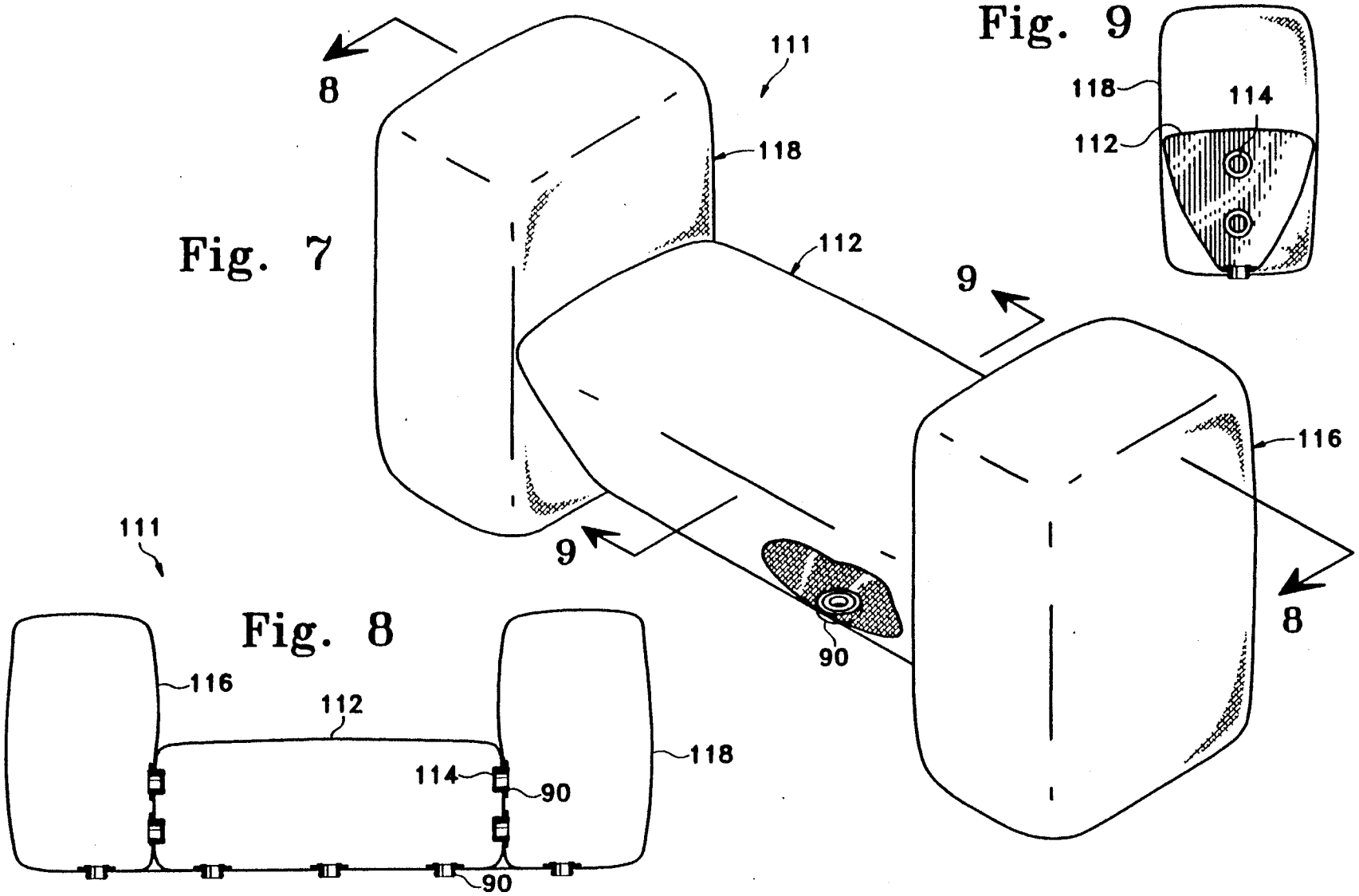
FIG. 7 is an isometric view of another embodiment of a restraining cushion assembly usable in the bed of FIG. 1.
FIG. 8 is a simplified cross section taken along line 8—8 in FIG. 7.
FIG. 9 is a simplified cross section taken along line 9—9 in FIG. 7.

More confining restraint is provided by the restraining cell assembly 111 illustrated in FIGS. 7–9. A short support cell 112 is constructed like cells 82 except that it is shorter in length, as shown, and has a pair of insert connectors 90 mounted in each end, as is described below with reference to FIG. 23. Attached to the insert connectors are connector receptacles 112, connected as shown in FIG. 23, that are mounted in respective side restraint cells 116 and 118. These cells extend from top plate 115 of platform 36 to well above the top surface 224 of cell 112. The inside faces 116*a* and 118*a* of the restraint cells are generally normally disposed relative to surface 86 so as to provide a barrier to movement of a patient toward the side of a bed. Since the restraint cells are coupled to short support cell 112, all three cells in cell assembly 111 are inflated to the same air pressure and occupy the same space on platform 36 as a single cell 82. In order to accommodate the broad bases of cells 116 and 118, the associated triangular base cells are made short like support cell 112.

Figure 10:
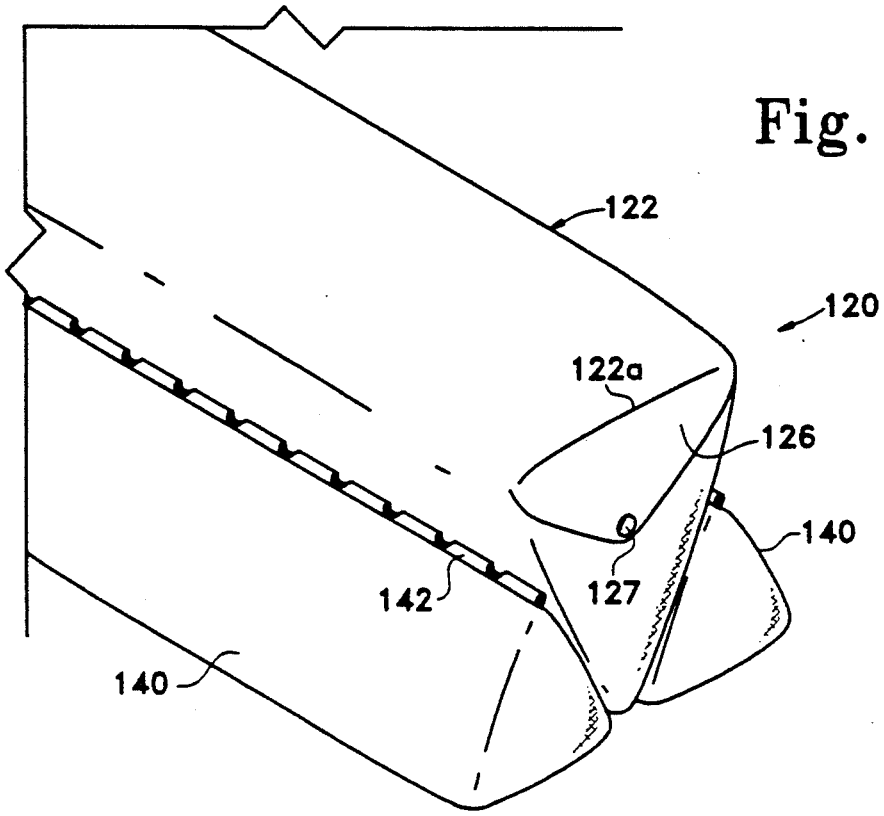
FIG. 10 is a partial isometric view of yet another embodiment of a restraining cushion assembly usable in the bed of FIG. 1.
Figure 13:
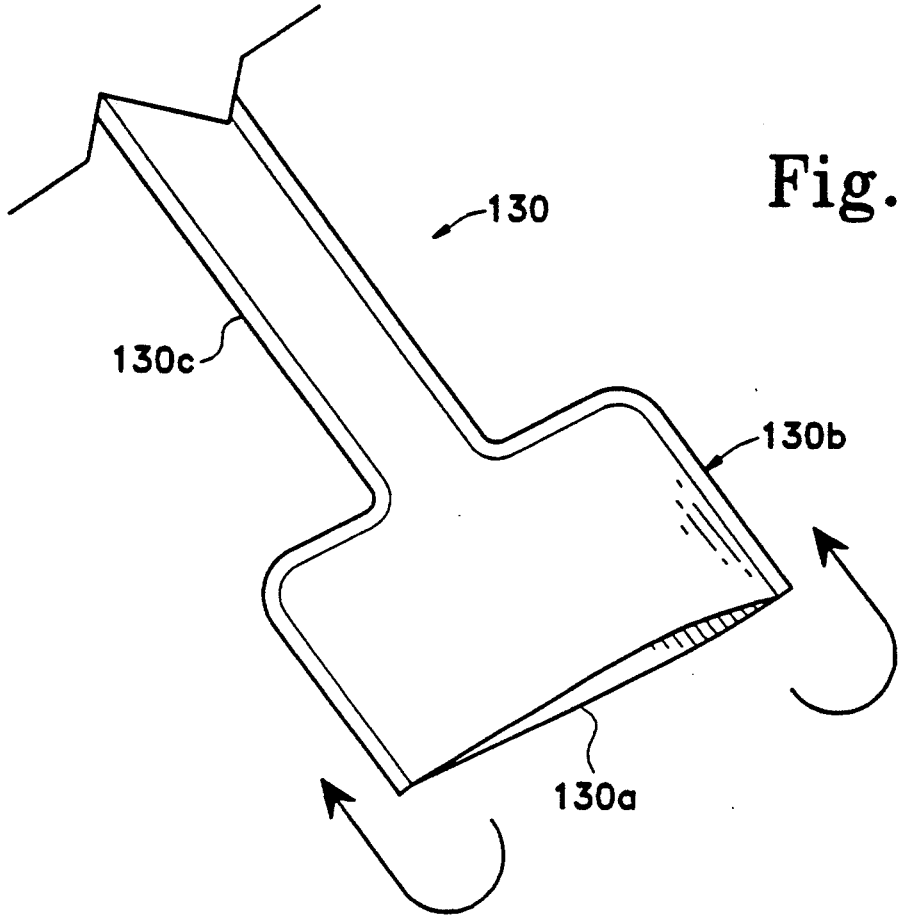
FIGS. 13 and 14 are partial isometric views of the cushion assembly of FIG. 10 illustrating the structure providing connection of the restraining cushion to a support cushion.
Figure 14:
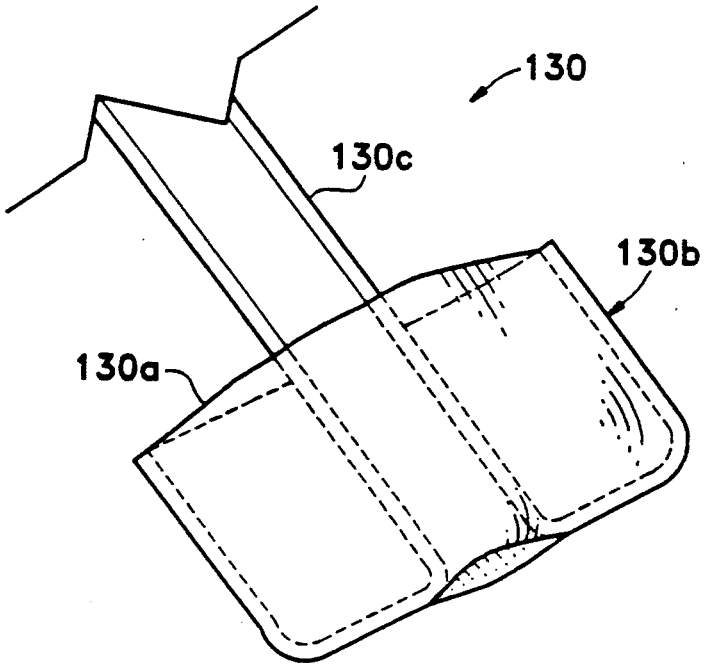

Yet another embodiment of a restraint cell assembly 120 is shown in FIGS. 10–18. A series of upper cells 122, similar to cells 82, form support surface 124. These cells have an opening 124 that is secured in a closed position, as shown in FIG. 10, by a flap 126 and snap elements 127 and 128. Opening 124 extends along the upper outer edge 122*a* of the cell. The opening is heat sealed to a correspondingly shaped lip 130*a* of an enlarged end or pouch 130*b*, also referred to, with flap 126, as an envelope, of a connector tube 130 connecting and tethering an auxiliary or restraint cell 132 by tube neck 130*c*, as is particularly shown in FIG. 12. Enlarged end 130*b* is sized sufficiently to serve as a pouch for storing the remainder of tube 130 and cell 132. The pouch is formed by turning the enlarged end over on the tube neck, as is illustrated in FIGS. 13 and 14.

Figure 11:
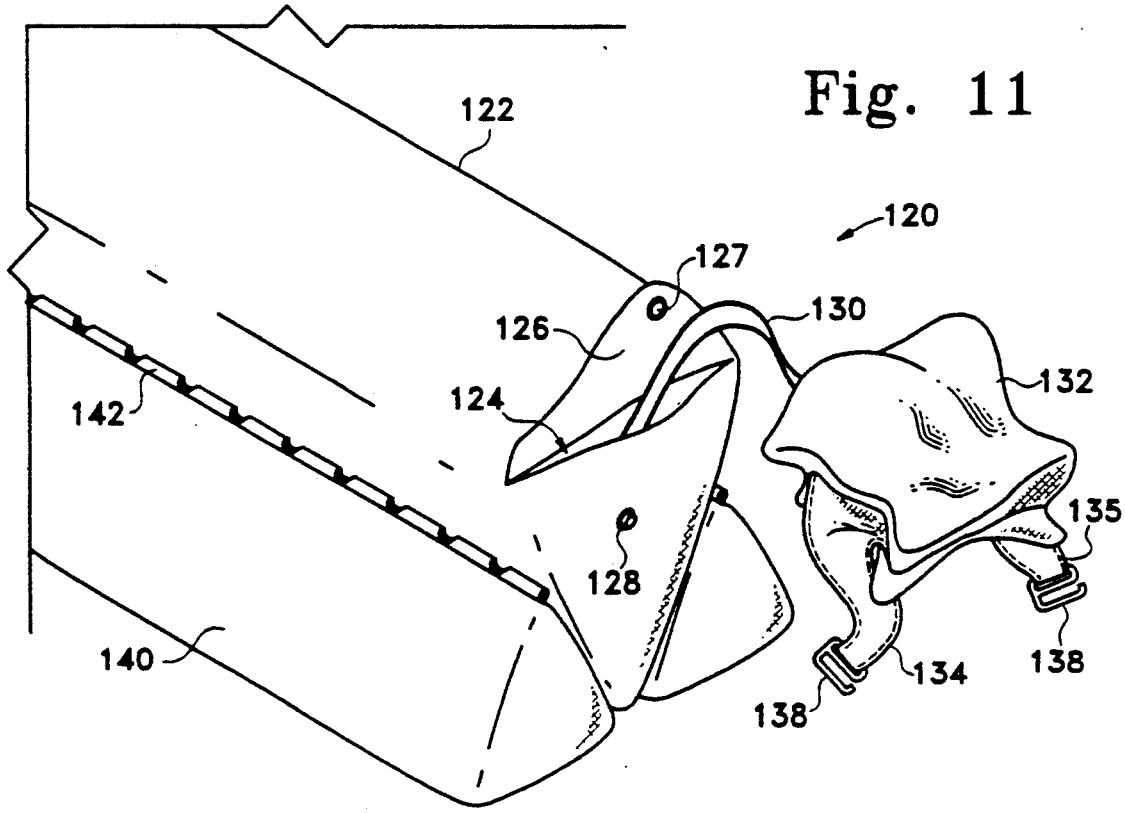
FIG. 11 is a view of the cushion assembly of FIG. 10 illustrating the removal of a restraining cushion from an end pouch in a cushion illustrated in FIG. 10.
Figure 12:
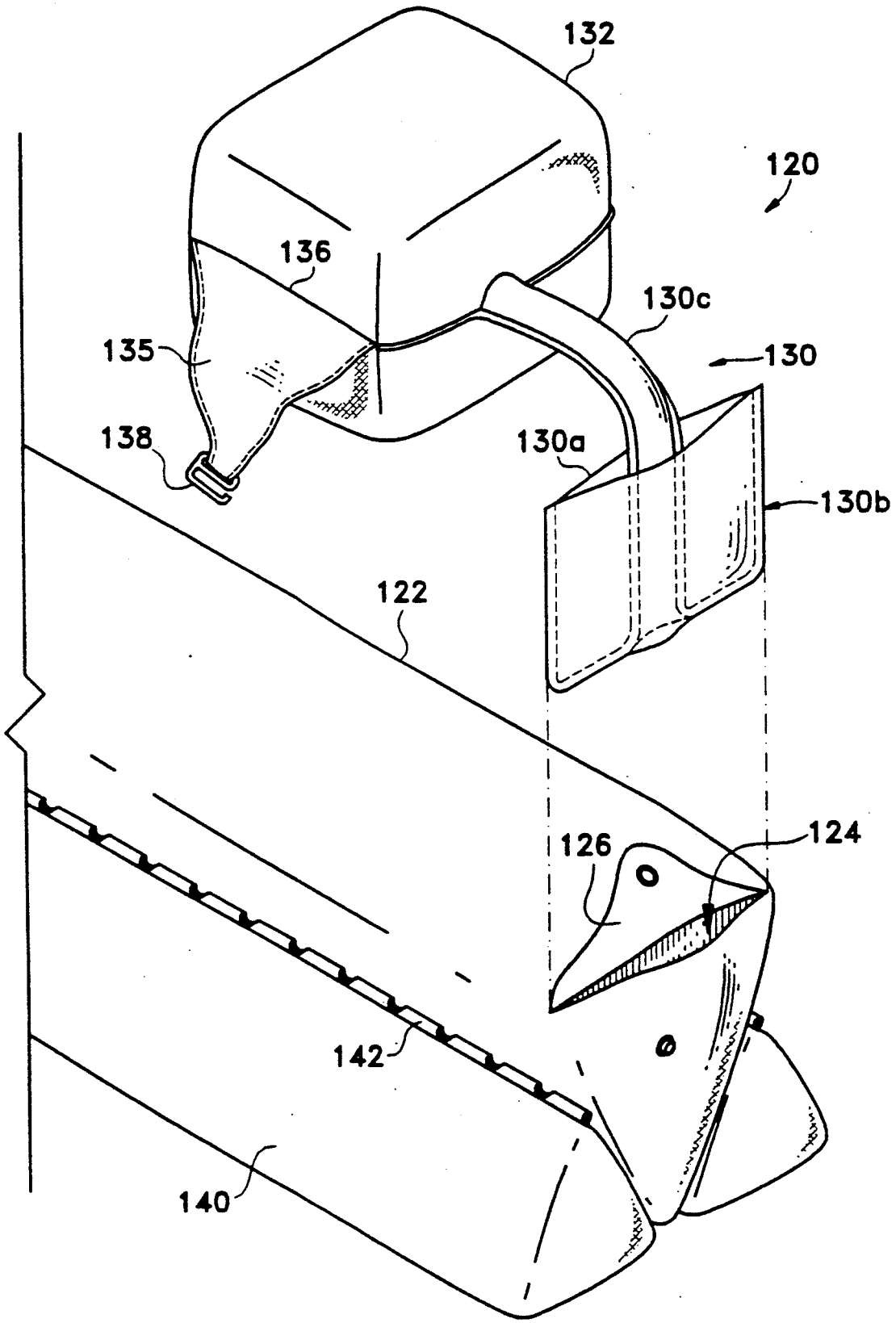
FIG. 12 is a partial exploded view of the cushion assembly of FIG. 10 showing assembly and inflation of the restraining cushion.
Figure 15:
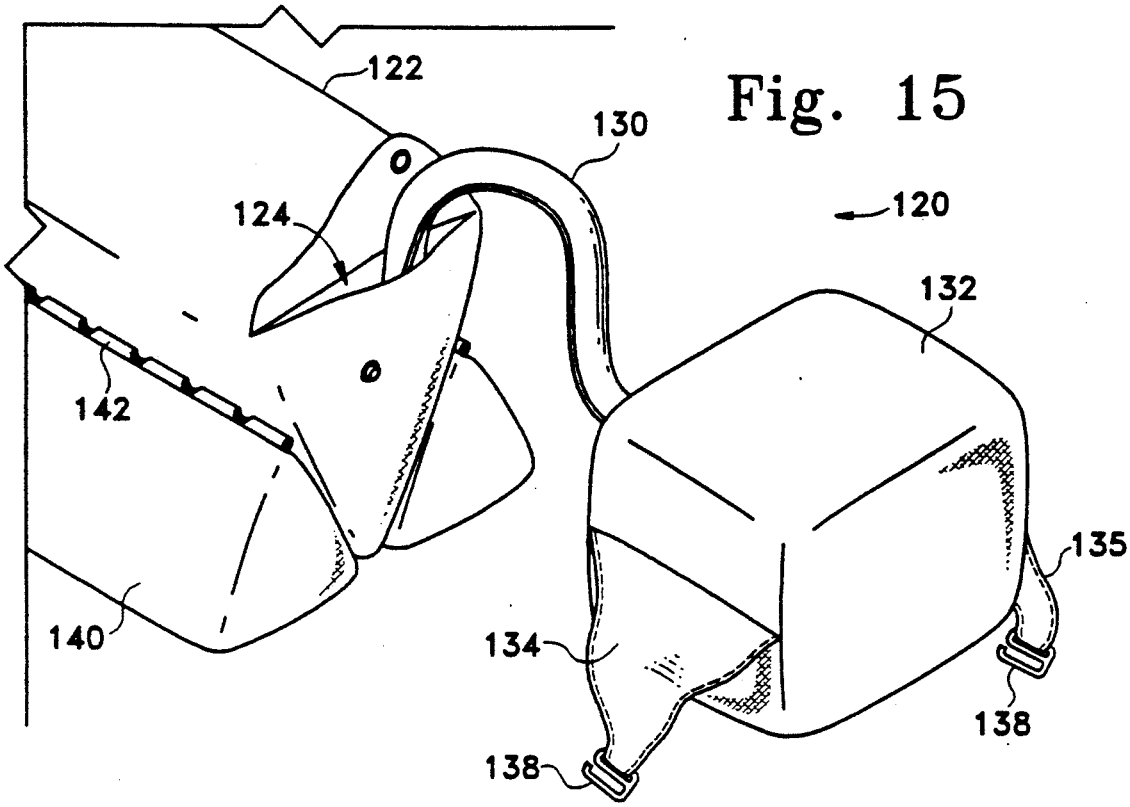
FIG. 15 is an isometric view of the cushion assembly of FIG. 10 showing inflation of the restraining cushion.

FIG. 10 shows cell 122 with cell 132 stored in pouch 130*b* and flap 126 secured to close opening 124. FIG. 11 shows cell assembly 120 after the flap has been released from the end of cell 122 and the restraint cell removed from the pouch. With cell 132 removed, the inflation pressure in cell 122, now in fluid communication through tube 130 to restraint cell 132, causes the restraint cell to also inflate, as shown in FIG. 15.

Figure 16:
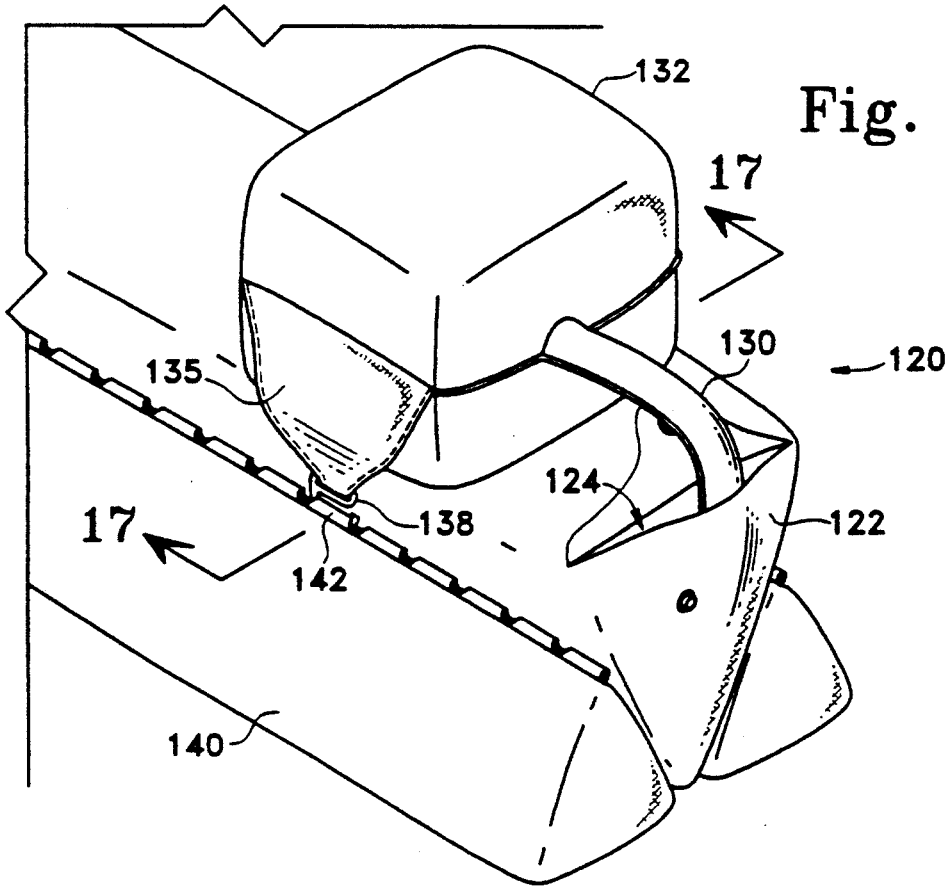
FIG. 16 is a view similar to FIG. 15 showing anchoring of the restraining cushion on a patient support cushion for the cushion assembly of FIG. 10.
Figure 17:
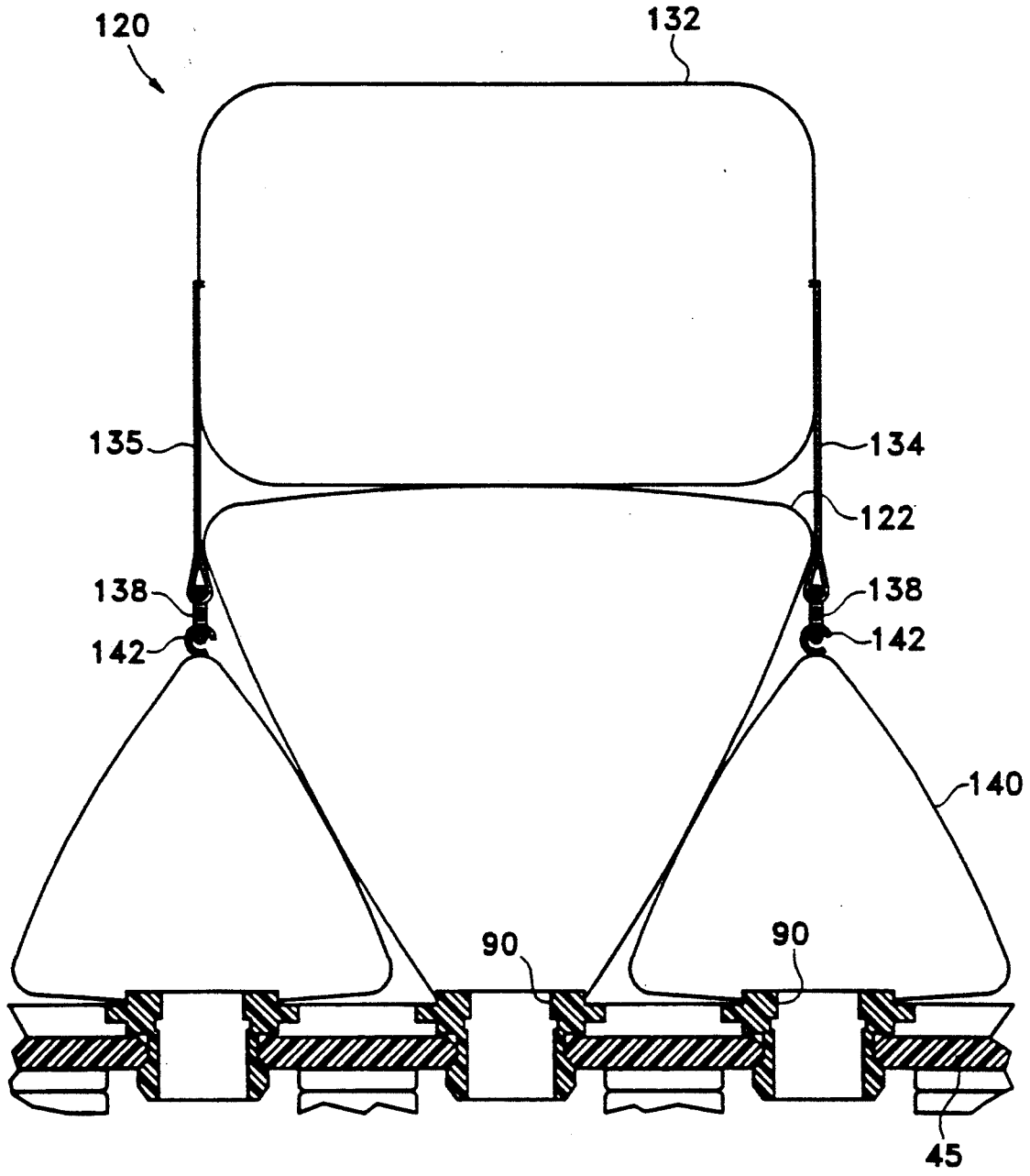
FIG. 17 is a simplified cross section taken along line 17—17 in FIG. 16.

As shown in this figure, restraint cell 132 has fabric flaps 134 and 135 depending from opposite sides of the cell. These flaps are preferably attached to the middle section of the sides at a seam 136 and extend substantially along the width of the sides. They extend to tips 134*a* and 135*a* where elongate loops or hooks 138 are attached, such as by sewing, as is conventionally known. Below and on each side of upper cells 122 are base cells 140, the same as base cells 84, except for a series of open sleeves or catches, such as catch 142, sized to receive hooks 138. FIGS. 16 and 17 show hooks 138 engaging catches 142 for anchoring restraint cell 132 in a desired position along upper cell 122. Catches 142 are thus also referred to as anchors. Since there are numerous catches disposed along the base cells, the restraint cells can be placed anywhere along the upper cell that is within the reach of tube 130. The extended width of flaps 134 and 135 prevents restraint cell 132 from being moved from the anchored position.

Figure 18:
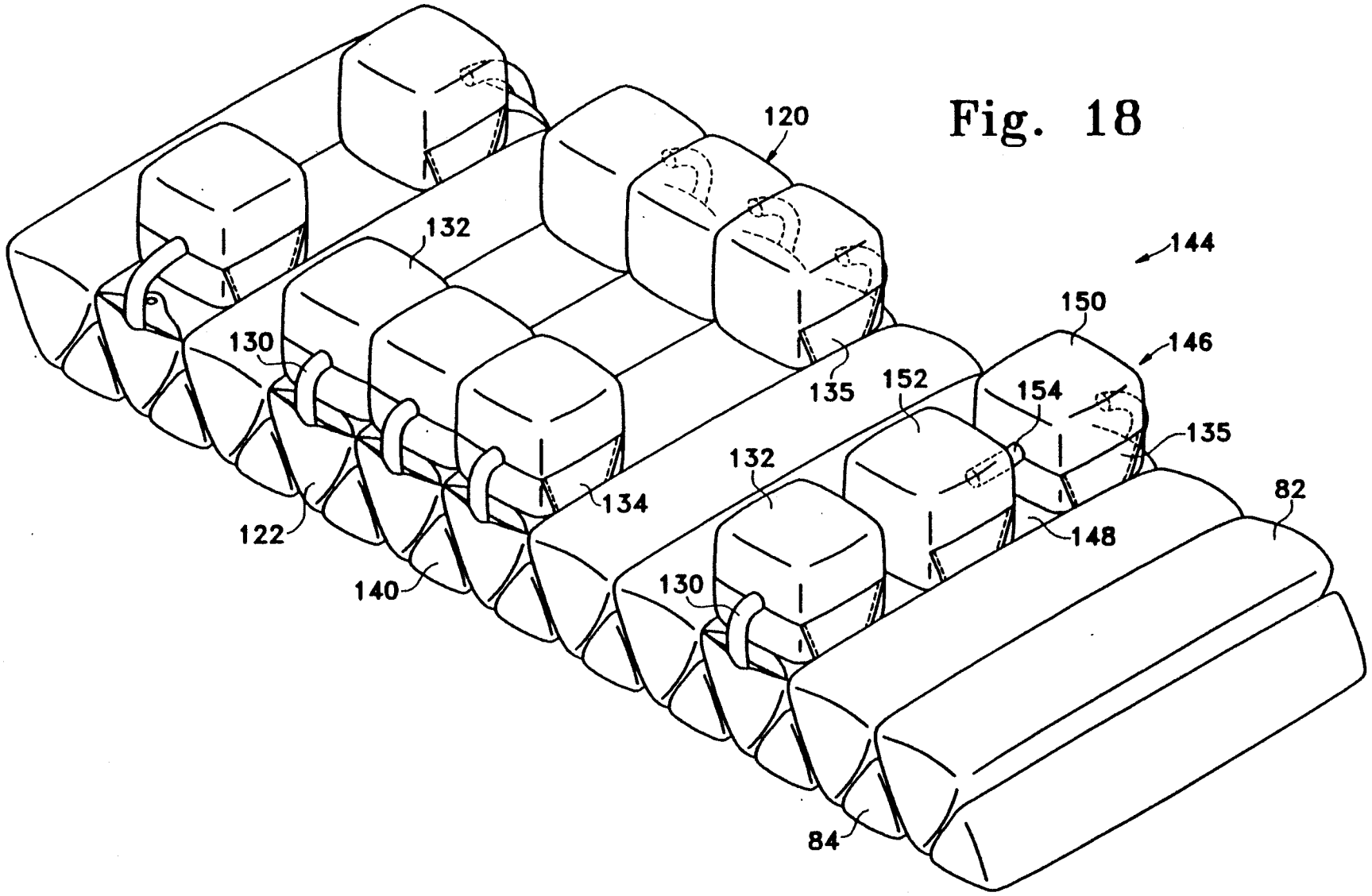
FIG. 18 is a view of a mattress usable in the bed of FIG. 1 incorporating an array of restraining cushion assemblies as illustrated in FIG. 10 for restraining a person.

FIG. 18 provides an illustration of a mattress 144 usable on a platform 36 formed using cell assemblies 122. An upper assembly 122' has opposing restraint cells anchored relatively close together, leaving enough space to accommodate a person's head. Three intermediate assemblies 122" have the restraint cells anchored adjacent to the ends of the associated upper cells, to accommodate the torso of a person. The adjacent restraint cells may be slightly offset, or the flaps can be formed so that the hooks of adjacent restraint cells are not in alignment, to allow connection to different latches on commonly used base cells. Alternatively, the respective catches can be made large enough, or double in structure for receiving two hooks.

It will be seen that several modifications of cell assembly 120 are realizable. For instance the pouch and cell 132 could be mounted on a base cell. Further, the catches could be mounted on the upper cell or even on the surface supporting the cells. Other methods of anchoring the restraint cell are also realizable.

A yet further modified restraint cell assembly 146 is shown near the foot of mattress 144. Assembly 146 includes an upper cell 148 the same as a cell 122, except that a restraint cell 150 is coupled to an intermediate restraint cell 152 by a connecting tube 154. Cells 132, 150 and 152 are spaced apart, as shown to accommodate the legs of a person laying on the mattress.

It will be noted that tube 154 is shown extending directly between cells 150 and 152. This is shown this way to facilitate illustration. The actual tube is sufficiently long to preferably extend along support surface 86 so that it will not interfere with the leg of person resting on the mattress.

Figure 19:
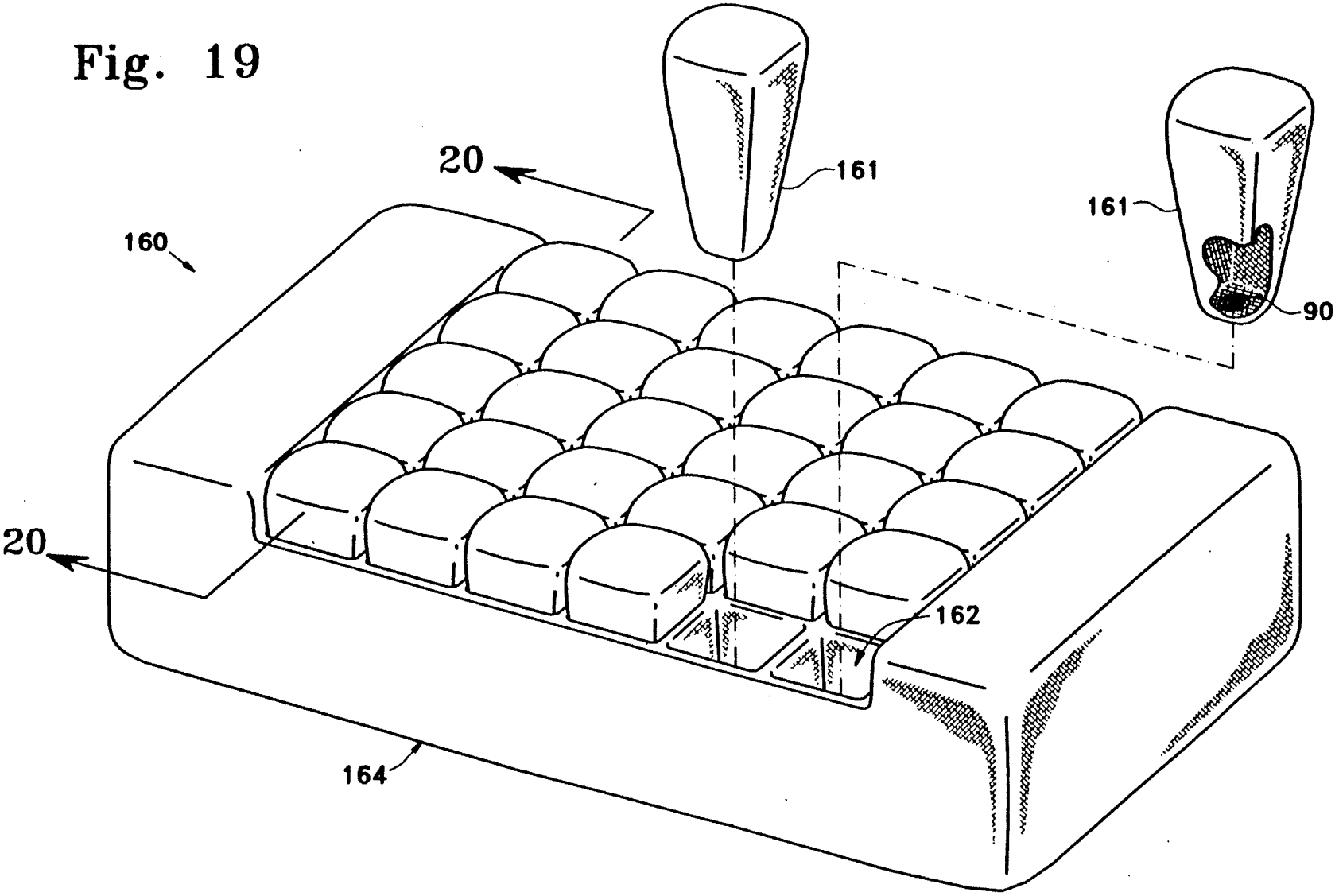
FIG. 19 is an isometric view of a portion of a second embodiment of a mattress made according to the invention.
Figure 20:
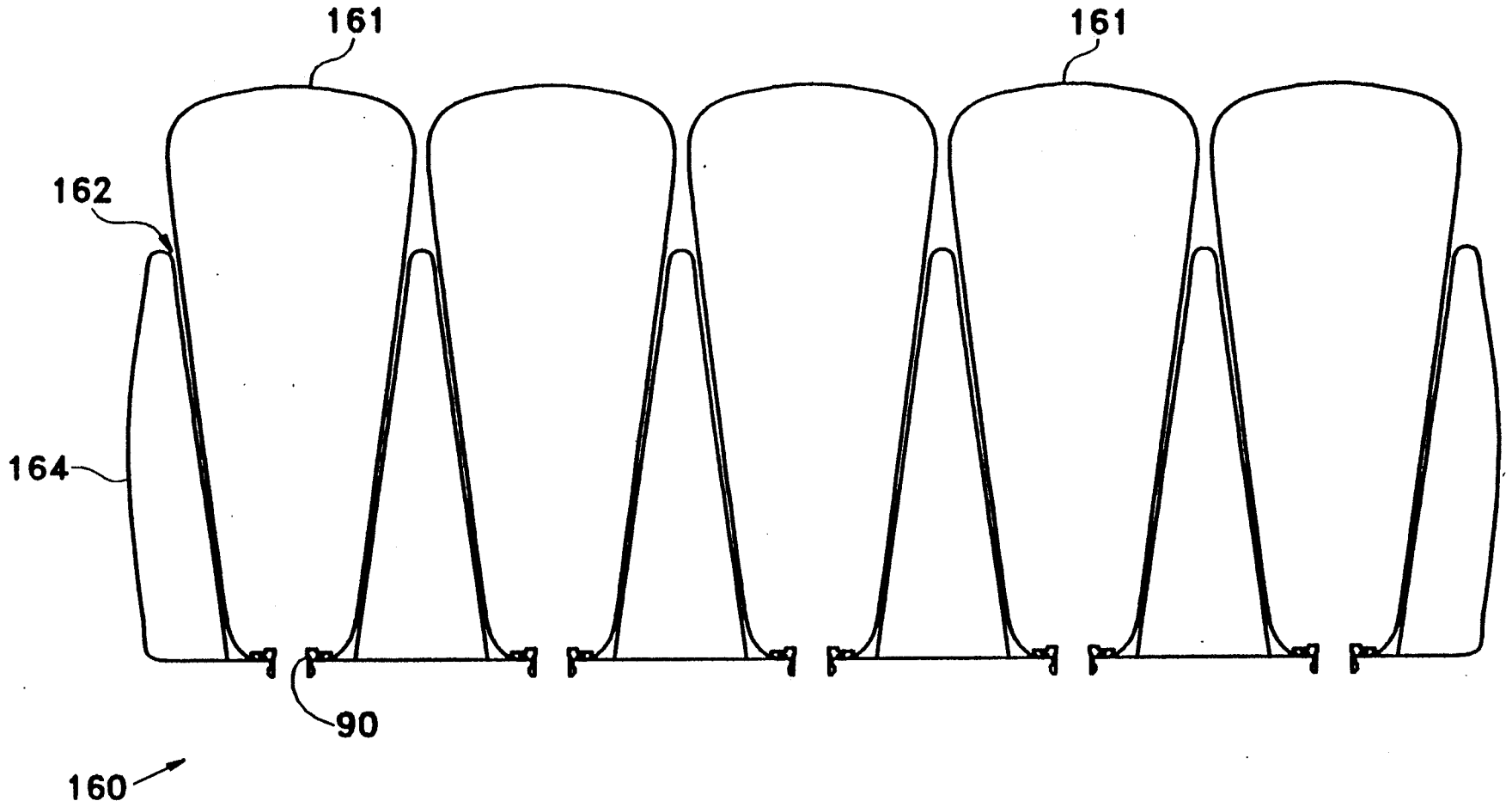
FIG. 20 is a simplified cross-sectional view showing the structure of the mattress of FIG. 19.

An alternative mattress structure is shown in FIGS. 19 and 20. FIG. 19 shows a mattress section 160 as is mounted on a single platform link or panel, such as one of panels 38–41. Such a section may be mounted on each of the four panels to form a bed having a uniform mattress. Clearly, the mattress sections can be varied to achieve a combination of capabilities.

Mattress section 160 includes 30 individual cells 161 that may be individually controllable, as is described in the previously referenced U.S. Pat. No. 5,023,967. Each cell has an insert connector 90, as was described with reference to FIG. 2, for connection to a coupling port of the top plate of a platform panel. The cells have a four-sided, inverted frustum-pyramidal shape, as shown, and are matingly received in correspondingly shaped cups, shown generally at 162.

Cups 162 are formed in a base mattress cell 164 that is maintained at a constant, fully inflated pressure. Alternatively, cell 164 could be formed of a semi-rigid material that has similar pliability and strength as an inflated cell. Thus, when an individual cell 161 is deflated, the surrounding cells are prevented from flexing into the now "empty" cup by the strength of the adjoining cup walls.

Figure 21:
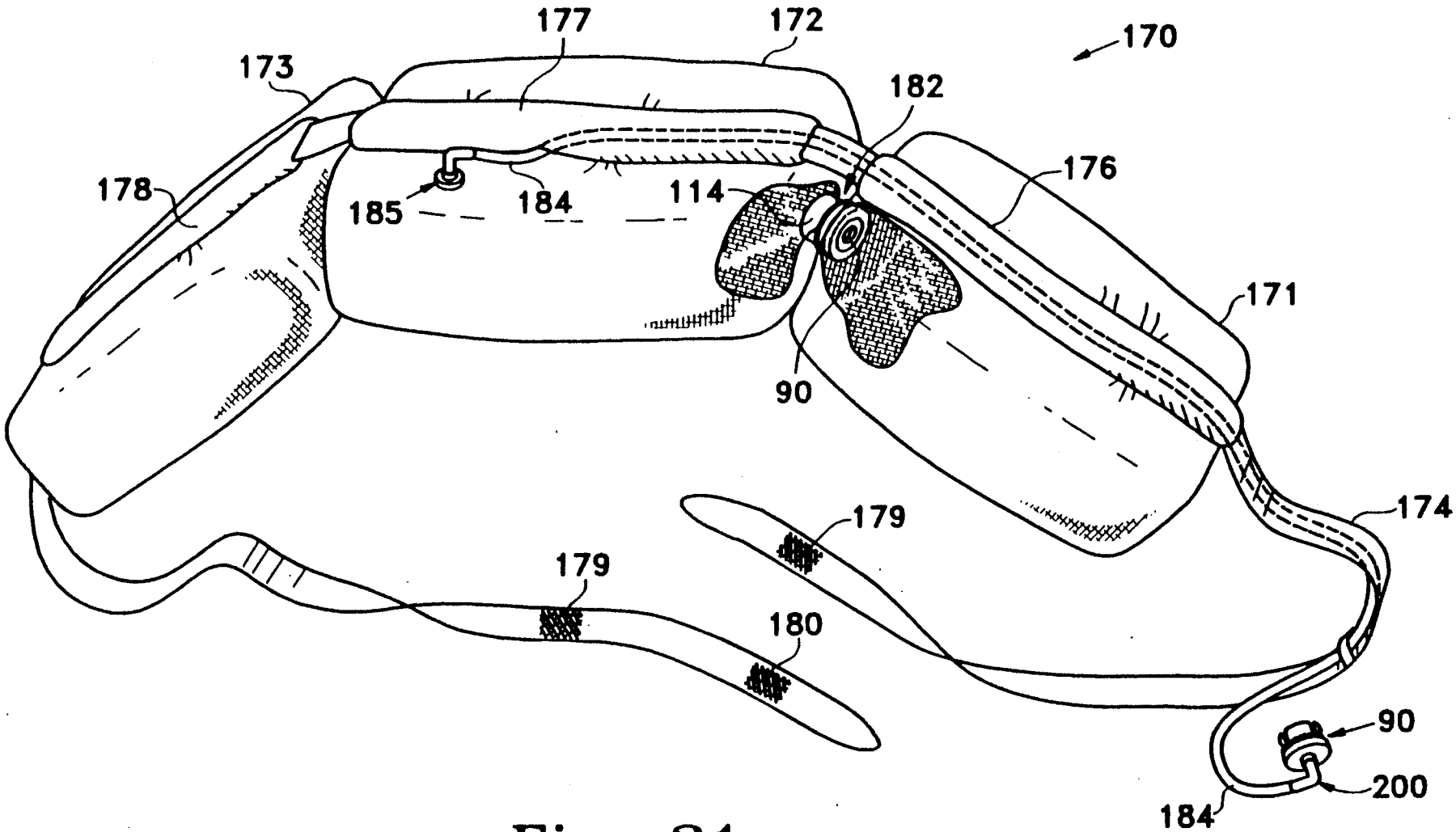
FIG. 21 is an isometric view of a restraining cushion system made according to the invention.
Figure 22:
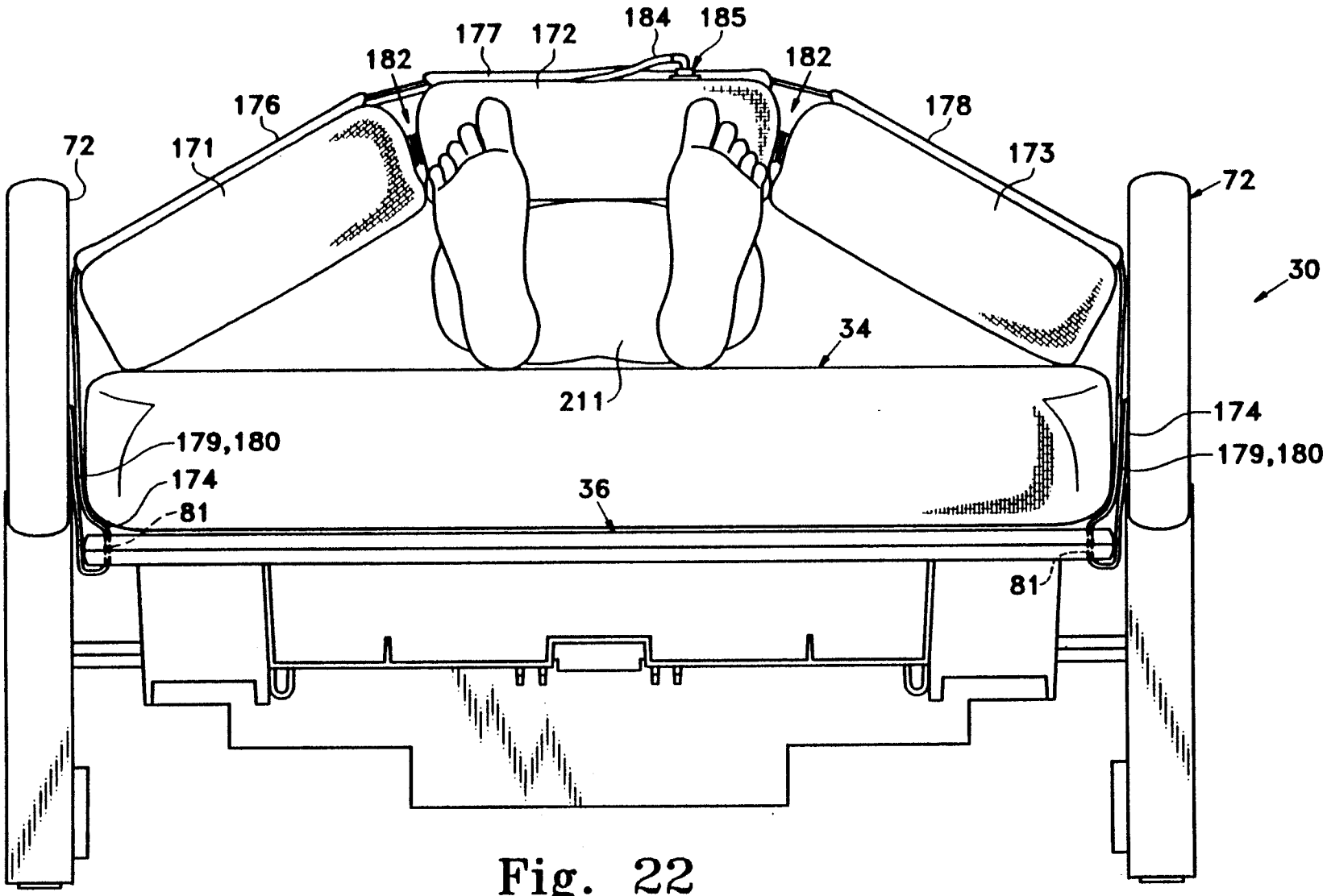
FIG. 22 is an end view of a bed showing the restraining cushion system of FIG. 21 in use.

The present invention also includes a cell systems for restraining further the movement of a person on a bed. These cell systems are shown in FIGS. 21–27. In particular, FIGS. 21 and 22 illustrate a restraining belt system 170 including three inflatable cells 171, 172 and 173. These cells are supported serially by a belt 174 that is held on a common, upper face of the cells by respective sleeves 176, 177 and 178. Belt 174 is preferably slidable in the respective sleeves relative to the cells. At each end of belt 174 are hook and loop fabric pieces 179 and 180 for securing the belt through a slot 181 in the platform panel edge, as is shown in FIG. 22. FIG. 22 shows an end view of the restraining belt system 170 fastened to a bed panel 39.

Figure 26:
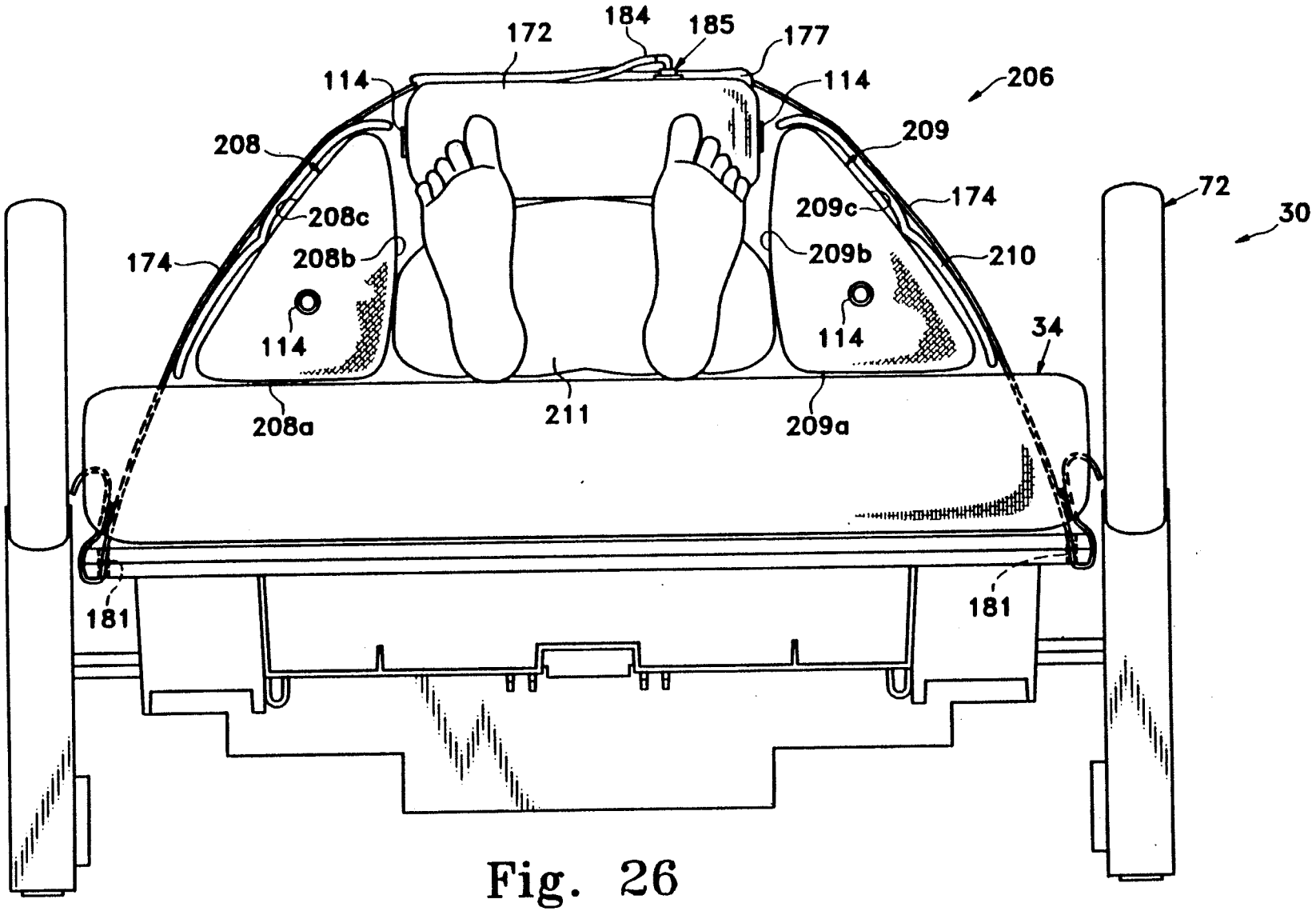
FIG. 26 is an end view of a bed showing the use of an alternative restraining belt system.

Cells 171 and 173 are each connected to cell 172 by a connector assembly 182, including an insert coupling member or connector 90 and a connector coupling member or receptacle 114, described in further detail with reference to FIGS. 23 and 24. Cells 171 and 173 are thereby inflated directly from cell 172. Receptacle 114 also functions as a check valve, so that when the end cells 171 and 173 are disconnected, cell 172 stays inflated, as is shown in FIG. 26. Cell 172 without cells 171 or 173 would be appropriate if the restraint cells 132 of a cell assembly 122 as shown in FIG. 18 is used with it.

Cell 172 is inflated via a tube 184 that extends through sleeves 177 and 178, and along belt 174 to an insert connector 90 with a tube reducer 200 for attachment to the tube. The tube is connected to cell 172 by a tube connector assembly 185. The tube end insert connector 90 is connected to a connector receptacle 114 mounted in a base mattress cell 84', as is shown in FIG. 1 and in FIG. 25.

FIG. 23 illustrates a connector assembly 182 formed of an insert connector 90 and a connector receptacle 114, such as is used between cells 171 and 172 or between cells 172 and 173. Connector receptacle 114 includes an outer member 187 having a general U-shape with walls **187*a* forming an inner cavity and having an open end 188 and an inward-directed lip or flange 187*b* defining a reduced opening 189. Around opening 189 is a recess 187*c*. Just inside walls 187*a* from open end 188 is a slight groove 187*d* sized to receive a corresponding ridge 190*a* of a seal member 190. Positioned inside outer member 187 in a disk chamber or cavity between flange 187*b* and a shoulder 190*b* of seal member 190 is a disk 191 that is freely movable therebetween. When pressed against shoulder 190*b*, such as when the insert connector is removed, a seal is formed, maintaining the pressure in a cell or cushion the connector receptacle is mounted in. When an insert connector 90 is inserted into an opening 192 extending through seal member 190, as is shown in the figure, the disk is held away from shoulder 190*b***, allowing air to flow around it.

Insert connector 90 includes a ring 194 having an inner diameter $D_3$ and inward-directed flange **194*a* defining a reduced diameter $D_4$. An insert member 196 defines a passageway 197. At one end is an outward-directed flange 196*a* having a shoulder 196*b*. Flange 196*a* is received by friction fit in the recess formed by flange 194*a* of ring 194. Extending away from flange 196*a* are a plurality of fingers 196*c* having longitudinally extending slits 198. These slits allow the fingers to flex inwardly during insertion and removal from a connector receptacle, and allow for the passage of air around disk 191 when received in a connector receptacle. Adjacent to the end 196*d* associated with flange 196*a* is an inner groove 196*e*. The diameters of groove 196*e* and recess 187*c*** are the same.

FIG. 24 shows a tube connector assembly 185 for connection to a tube 184, as shown in FIG. 21. Assembly 185 includes disk-like reducer 200 having an outer diameter sized to be received with a friction fit in a recess 187c or a groove 196e, as is shown in phantom lines in FIG. 23, or in a reducer mounting ring 203, as is shown in FIG. 24. An inner opening 201 is defined by walls 200a threaded to receive a tube adaptor 202 that is connectable to a tube, such as tube 184.

Figure 25:
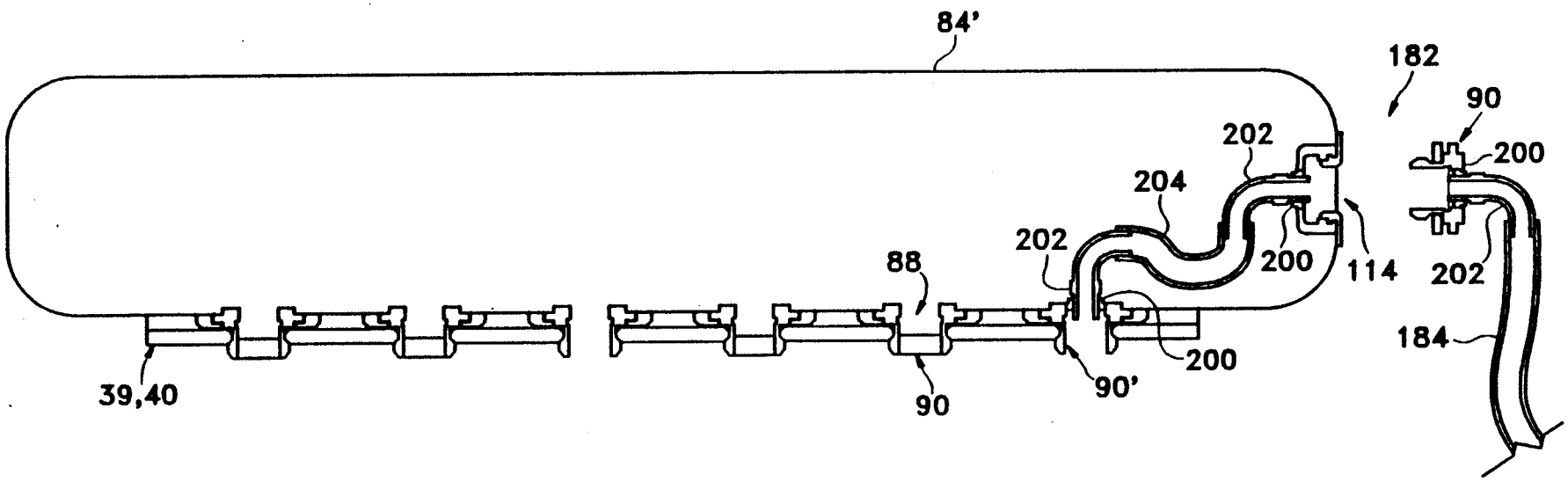
FIG. 25 is a cross-section of a cell modified to provide communication of the air supply with a secondary cell.

FIG. 25 shows a cross section of a cell 84' cut away to show the internal structure. Cell 84' is inflated through inlet port 88 defined by insert connector 90 connected to a coupling port of the top plate of a panel, as has been described with reference to FIG. 2. However, cell 84' also has a second insert connector 90' to which is attached a reducer assembly 186. Assembly 186 is connected to a conduit or tube 204, the other end of which is connected to a second reducer assembly 186 mounted on a connector receptable 114, also referred to as an outlet coupling member, mounted on the end of cell 84', as shown. Tube 204 thus is means for joining insert connector 90' to receptable 114 in the end of cell 84'. The insert connector shown on the end of tube 184 in FIG. 25 is insertable in receptable 114 to provide inflation of the restraining cells shown in FIGS. 21 and 22.

Figure 27:
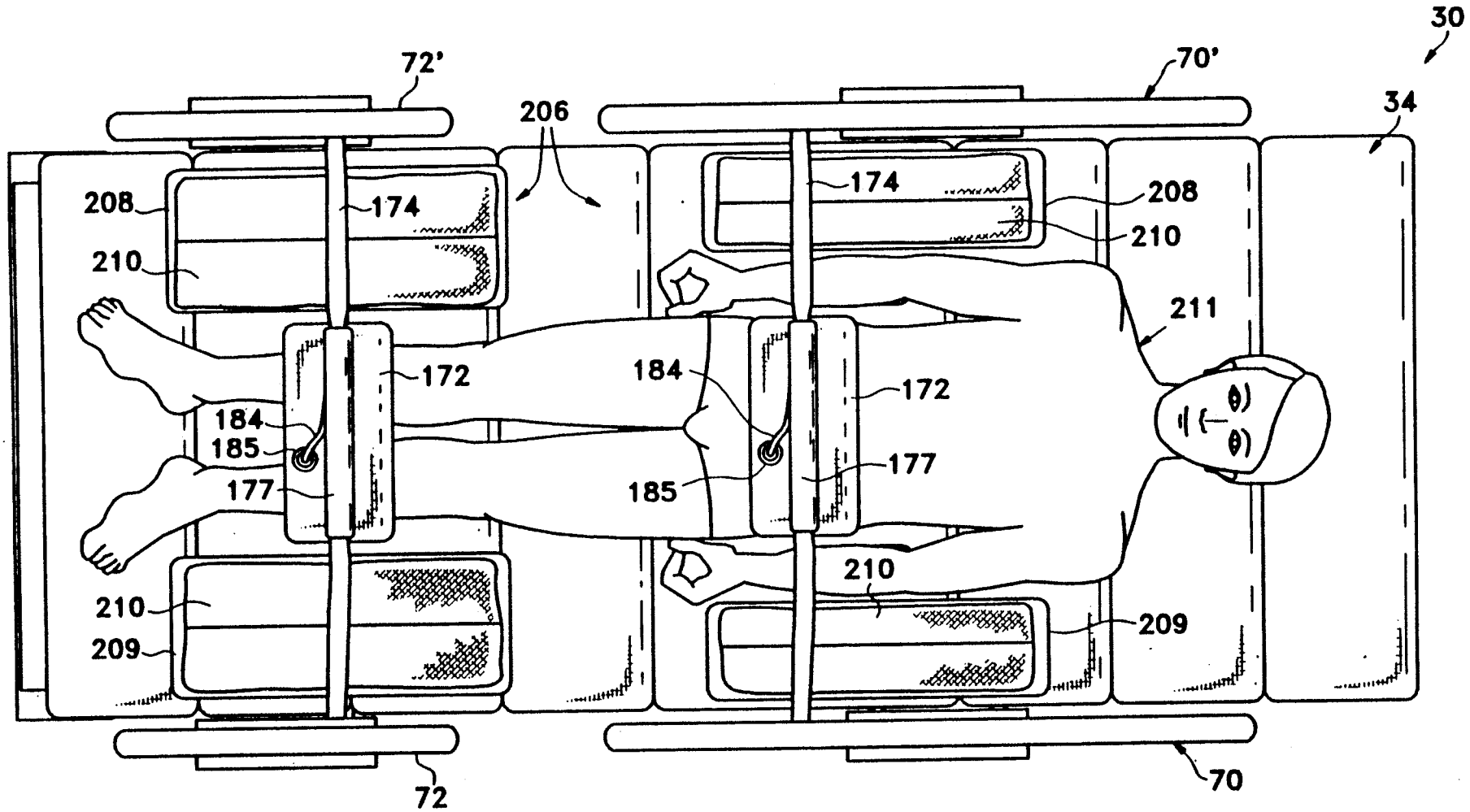
FIG. 27 is a top view of the bed of FIG. 26.

FIGS. 26 and 27 illustrate an alternative restraining system 206 that includes all the parts of belt system 170 except the outer cells 171 and 173. As a result, for clarity of illustration, those parts that are common to belt system 170 have the same reference numbers. Replacing the outer cells are extended side cells 208 and 209. As particularly shown in FIG. 26, these side cells have a right-triangle cross section, preferably in the ratio 3-4-5. In the preferred embodiment short sides 208a and 209a have lengths of 6 inches, long sides 208b and 209b have lengths of 8 inches, and hypotenuses 208c and 209c have lengths of 10 inches. A protective stretch or web of a fabric tether 210 is generally coextensive with the hypotenuse and is attached along the length of the hypotenuse, as shown.

Each side cell is inflated via a connector receptable 114 that functions as a check valve to prevent leaking after inflation. Alternatively, the side cells can be left connected to an inflating tube all the time.

As shown in FIG. 27, when restraining belt system 206 is used to contain the legs of a patient 211, long sides 208b and 209b are placed against the top surface of the mattress. However, when the belt system is used to restrain the torso, since the torso is wider on the bed and extends higher above the bed than the legs, the short sides 208a and 209a are placed on the mattress surface, thereby accommodating the variations in the patient's body structure without using different cells.

It will be apparent to one skilled in the art that many variations in form and detail may be made in the preferred embodiments as illustrated and described above without varying from the spirit and scope of the invention that the claims define or are interpreted or modified according to the doctrine of equivalents. The preferred embodiments of the various features of the invention are thus provided for purposes of explanation and illustration, but not limitation.

We claim:

1. A bed comprising:

means defining a generally planar upwardly facing support surface;

an inflatable mattress supported on said surface comprising first and second separately inflatable cells having contiguous faces extending, when inflated, obliquely relative to the support surface, with the contiguous face of said first cell extending over the contiguous face of said second cell, said second cell having an upward-pointing, generally triangular shape when viewed in a plane generally normal to said contiguous face and to said support surface; and means for securing said first and second cells to said defining means with said first cell partially supported on said second cell when a person is supported on said mattress.

2. A bed according to claim 1 wherein said first cell has a downward-pointing, generally triangular shape when viewed in said plane generally normal to said contiguous face and to said support surface.

3. A bed according to claim 2 wherein said first cell extends further from said support surface than said second cell.

4. A bed according to claim 3 wherein said mattress further comprises a plurality of said first and second cells supported on said support surface in alternating positions.

5. A bed according to claim 4 further comprising means for individually inflating said cells, including maintaining the inflation of said second cells and selectively inflating said first cells, whereby each first cell is held in an upright position by the adjacent second cells, regardless of the level of inflation of the adjacent first cells.

6. A bed comprising:

means defining a generally planar upwardly facing support surface;

an inflatable mattress supported on said surface comprising first and second separately inflatable cells having contiguous faces extending, when inflated, obliquely relative to the support surface, with the contiguous face of said first cell extending over the contiguous face of said second cell, said first cell forming a cup for receiving said second cell; and means for securing said first and second cells to said defining means with said first cell partially supported on said second cell when a person is supported on said mattress.

7. A bed according to claim 6 wherein all of said contiguous faces of said second cell are oblique and said contiguous faces of said first cell forming said cup conform to the corresponding contiguous faces of said second cell.

8. A bed according to claim 7 wherein said first cell further comprises a plurality of said cups and said mattress further comprises a plurality of said second cells.

9. A bed according to claim 6 wherein said second cell has faces conforming to said cup.

10. A bed according to claim 9 wherein said first cell further comprises a plurality of said cups and said mattress further comprises a plurality of said second cells.

11. A bed comprising:

means defining a generally planar upwardly facing support surface;

an inflatable mattress supported on said surface comprising first and second separately inflatable cells having contiguous faces extending, when inflated, obliquely relative to the support surface, with the contiguous face of said first cell extending over the contiguous face of said second cell, said first cell having opposing ends and an intermediate section, with said opposing ends extending further from said support surface than said intermediate section; and means for securing said first and second cells to said defining means with said first cell partially supported on said second cell when a person is supported on said mattress.

12. A bed according to claim 11 wherein said first cell has an upper surface associated with each opposing end that slopes transversely relative to said support surface from said intermediate section toward the respective end.

13. A bed according to claim 12 wherein said upper surfaces extend from the middle of said first cell to said opposing ends.

14. A bed comprising:

means defining a generally planar upwardly facing support surface;

an inflatable auxiliary cell;

an inflatable mattress supported on said surface comprising first and second separately inflatable cells having contiguous faces extending, when inflated, obliquely relative to the support surface, with the contiguous face of said first cell extending over the contiguous face of said second cell, one of said first and second cells including an envelope for storing said auxiliary cell in a deflated condition and conduit means coupling said one cell and said auxiliary cell for inflating said auxiliary cell when removed from said envelope; and means for securing said first and second cells to said defining means with said first cell partially supported on said second cell when a person is supported on said mattress.

15. A bed according to claim 14 further comprising means for securing said auxiliary cell relative to said one cell.

16. A bed according to claim 15 wherein said one cell is said first cell, said securing means comprises means for attaching said auxiliary cell to said second cell with said auxiliary cell positioned on said first cell.

17. A bed according to claim 16 wherein said first and auxiliary cells have opposite sides, said first cell has a second cell disposed on each side, each with an upper surface, and said securing means includes an anchor mounted to said upper surface of each of said second cells and a strap for connecting each side of said auxiliary cell with the associated anchor.

18. A bed according to claim 17 further comprising a plurality of said anchors mounted along said upper surface of each of said second cells, and said straps are selectively positionable on each of said anchors.

19. A bed comprising:

means defining a generally planar upwardly facing support surface;

an auxiliary cell;

an inflatable mattress supported on said surface comprising at least one inflatable cell extending laterally on said support surface for supporting a person, said one cell having an envelope for storing said auxiliary cell in a deflated condition; and conduit means coupling said one cell and said auxiliary cell for inflating said auxiliary cell when removed from said envelope.

20. A bed according to claim 19 further comprising means for securing said auxiliary cell relative to said one cell.

21. A bed according to claim 20 wherein said one and auxiliary cells have opposite sides, and said securing means includes an anchor mounted on each side of said one cell relative to said support surface and a strap for connecting each side of said auxiliary cell with said associated anchor.

22. A bed comprising:

means defining a generally planar upwardly facing support surface;

an auxiliary cell;

an inflatable mattress supported on said surface comprising at least one inflatable elongate cell extending laterally on said support surface for supporting a person; and means for securing said auxiliary cell selectively along said one cell.

23. A bed according to claim 22 wherein said securing means includes a first plurality of anchors mounted along one side of said one cell relative to said support surface and means for attaching said auxiliary cell to a selected one of said anchors.

24. A bed according to claim 23, wherein said one cell has another side opposite said one side, said bed further comprising a second plurality of said anchors mounted along the other side of said one cell relative to said support surface and means for attaching said auxiliary cell to a selected one of said second plurality of said anchors.

25. A bed according to claim 24 wherein said auxiliary cell has opposing sides corresponding to the sides of said one cell, and each of said attaching means comprises a strap having an end attached to a corresponding one of said opposing sides of said auxiliary cell, and a hook attached to the other end of said strap selectively engageable with each of said anchors in said associated plurality of anchors.

26. A bed according to claim 22 further comprising one of said auxiliary cells for each end of said one cell, one of said securing means for each of said auxiliary cells for securing the associated auxiliary cell adjacent to the corresponding end of said one cell, an inflatable restraining cushion sized to fit serially between said auxiliary cells and over a person supported on said mattress, means for securing said restraining cushion between said auxiliary cells and over said one cell, and means for inflating said restraining cushion.

27. A bed comprising:

means having an upwardly facing support surface;

a mattress having opposing sides and an inflatable cell supported on said support surface for supporting a person; and a restraining cushion assembly including a plurality of inflatable restraining cushions sized to fit serially between said mattress sides and over a person supported on said mattress, means for securing said restraining cushions relative to said mattress, means for inflating a first of said restraining cushions, and means coupling said first restraining cushion to a second restraining cushion for providing fluid communication between said first and second restraining cushions, so that said second restraining cushion inflates when said first cushion inflates.

28. A bed according to claim 27 wherein said means for inflating said first restraining cushion couples said inflatable cell to said first restraining cushion for inflating said first restraining cushion when said inflatable cell is inflated.

29. A bed according to claim 27 wherein said coupling means is disengageable for uncoupling said first and second restraining cushions.

30. A bed according to claim 29 wherein said coupling means includes means for sealing said first restraining cushion when said second restraining cushion is disengaged.

31. A bed according to claim 27 wherein said plurality of restraining cushions have a generally uniform thickness.

32. A bed according to claim 27 wherein said mattress has a generally uniform upper surface for supporting a person, and at least one of said restraining cushions has a first side that is generally orthogonal to and longer than a second side when viewed from an end of said mattress, and wherein said securing means secures said one restraining cushion selectively with one of said first and second sides on said mattress and the other of said first and second sides facing inwardly toward a person supported on said mattress, whereby said one restraining cushion is positionable at different positions along a person's body for providing different amounts of space for a person supported on said mattress.

* * * * *